US005928988A

United States Patent [19]

Yamane et al.

[11] Patent Number: 5,928,988

[45] Date of Patent: Jul. 27, 1999

[54] THERMOSENSITIVE REVERSIBLE RECORDING MATERIAL

[75] Inventors: Kazuo Yamane, Chiba; Makoto Nishioka, Yokohama, both of Japan

[73] Assignee: OJI Paper Co., Ltd., Tokyo, Japan

[21] Appl. No.: 08/952,822

[22] PCT Filed: Apr. 3, 1997

[86] PCT No.: PCT/JP97/01153

§ 371 Date: Dec. 3, 1997

§ 102(e) Date: Dec. 3, 1997

[87] PCT Pub. No.: WO97/37857

PCT Pub. Date: Oct. 16, 1997

[30] Foreign Application Priority Data

| | | | |
|---|---|---|---|
| Apr. 4, 1996 | [JP] | Japan | 8-082633 |
| Jul. 18, 1996 | [JP] | Japan | 8-189014 |
| Jul. 18, 1996 | [JP] | Japan | 8-189521 |
| Sep. 6, 1996 | [JP] | Japan | 8-236055 |

[51] Int. Cl.[6] ..... B41M 5/34

[52] U.S. Cl. ..... 503/216; 503/201; 503/225; 503/226

[58] Field of Search ..... 503/201, 216, 503/225, 226; 427/150–152

[56] References Cited

U.S. PATENT DOCUMENTS 4,628,337 12/1986 Sekine et al. ..... 503/217

FOREIGN PATENT DOCUMENTS 0 620 122 10/1994 European Pat. Off. ..... 503/216

5-32061 2/1993 Japan ..... 503/216

6-344673 12/1994 Japan ..... 503/216

7-257033 10/1995 Japan ..... 503/216

8-67665 3/1996 Japan ..... 503/216

8-132737 5/1996 Japan ..... 503/216

*Primary Examiner*—Bruce H. Hess

*Attorney, Agent, or Firm*—Nikaido, Marmelstein, Murray & Oram LLP

[57] ABSTRACT

A thermosensitive reversible recording material having a thermosensitive recording layer formed on a substrate sheet and including a substantially colorless dye precursor and a color developing agent capable of reversibly color-developing and erasing the dye-precursor, in which the color developing agent comprises an aromatic compound of the general formula (1) and optionally an overcoat layer preferably containing an electron-beam or ultraviolet-ray cured polymer is formed on the thermosensitive recording layer general formula (1):

(1)

[R=naphthyl or lower alkoxy-substituted phenol group, Y=—NHCO—, —SCONH—, —CONHCO—, —NHCONH—, —OCO—, —NHCOO—, —NHCOS—, —S—, —NHCONHSO$_2$—, —O—, —OCSNH—, —CONHNH—, —OCONHSO$_2$—, —CO—, —SCSNH—, —NHSO$_2$—, —CONHSO$_2$—, —OSO$_2$—, —NHCSNH—, or —N=CH— groups, n=integer of 11–30]

9 Claims, 1 Drawing Sheet

THERMOSENSITIVE REVERSIBLE RECORDING MATERIAL

DESCRIPTION

1. Technical Field

The present invention relates to a thermosensitive reversible recording material capable of being recorded by color-developing and of being erased by color-erasing, and of holding the color-developed condition and the color-erased condition at room temperature. More particularly, the present invention relates to a thermosensitive reversible recording material capable of forming colored images having a high contrast on a white. ground, having a good image-retention characteristic and capable of being repeatedly color-developed and color-erased many times.

2. Background Art

Generally, since a thermosensitive recording apparatus is compact and cheap and is easy to maintain, a thermosensitive recording material has been used as an output sheet for computers, measurement equipments, registers, CD·ATM, facsimiles, automatic ticket vending machines, and hand-held terminals and, recently, as a magnetic and thermosensitive recording card for prepaid cards and point cards, in which a magnetic recording facility is added. In conventional magnetic, thermosensitive recording cards, while the magnetic information can be renewed at every use, the thermally recorded images cannot be renewed and additional information, for example, remaining number of uses, must be additionally recorded in a portion of the card free from the recorded images. However, since the area of the portion of the card capable of receiving the additional information is limited, the amount of the thermally recorded information is limited or, when the additional information-recording area is filled, the card is replaced by a new one. Accordingly, to solve the above-mentioned disadvantages, a development of a thermosensitive reversible recording material capable of repeatedly renewing the information record has been strongly demanded.

Also, based on a recent emphasis on waste-treatment and forest-preservation, re-use of the thermosensitive recording material is desired. There have been various attempts to re-using thermosensitive recording material. Especially, a thermosensitive reversible recording material capable of repeatedly renewing the recorded information many times is demanded to be developed, as widely usable means which does not need a large scale of apparatus, for example, an ink-removing apparatus.

Also, the thermosensitive reversible recording materials as disclosed in Japanese Unexamined Patent Publications No. 3-233,490 and No. 5-42,762 have attracted public attention as a recording material for simple display, and a thermosensitive reversible recording material suitable for the above-mentioned display apparatus is strongly demanded to be developed.

On the basis of the above-mentioned demands, various types of reversible thermosensitive recording materials have been proposed.

For example, in Japanese Unexamined Patent Publications No. 63-107,584, No. 4-78,573 and No. 4-358,878, reversible thermosensitive recording materials utilizing a polymer capable of changing transparency thereof in response to heating conditions are described. However, since these recording materials utilize a transparent-to-opaque changing phenomenon due to a phase transition of the polymer, a satisfactory transparency and a sufficient opacity cannot be easily obtained, the contrast between the color-developed images and the color-erased image traces is low, and naked eye-observation in the dark is difficult. Also, in general, the above-mentioned type of recording materials are disadvantageous in that since white images are recorded on a colored ground of the recording material, a recording material capable of recording colored images on a white ground, namely, a paper-like recording material, is difficult to obtain.

As means for solving the above-mentioned problems of the conventional reversible thermosensitive recording materials, a dye-type reversible thermosensitive recording material using a conventional dye usable for conventional thermosensitive recording materials and capable of reversibly recording with the dye is known. The dye type reversible thermosensitive can easily record colored images in a white ground, and utilizes a change in absorption light wavelength due to heating conditions, and the resultant recorded images have relatively high contrast. As the above-mentioned dye type reversible thermosensitive recording material, the following systems are known.

In Japanese Unexamined Patent Publications No. 58-191,190 and No. 60-192,691, a system using, as a developing agent, gallic acid or phloroglucinol. However, this type of system is disadvantageous in that since erasure of the colored images needs water or water vapor, the color-erasing apparatus must have a large size.

Japanese Unexamined Patent Publications No. 60-264,285 and No. 62-140,881 disclose a system using a thermochromic material with hysteresis. This type of system is disadvantageous in that since the colored image-retaining temperature range is limited in both the upper and lower limits thereof, the apparatus for the system is complicated and there is a limitation in the temperature during utilization.

Japanese Unexamined Patent Publication No. 63-173,684 discloses a system using, as a color-developing agent, an ascorbic acid derivative. This system is disadvantageous in that in erasing the colored images, erasure cannot be fully effected.

Japanese Unexamined Patent Publications No. 2-188,293 and No. 2-188,294 disclose a system in which a salt of a specific organic acid such as gallic acid with a higher aliphatic amine is used as a color-developing agent. This system is, however, disadvantageous in that since the color-developing reaction and the color-erasing reactions are competitive with each other, it is difficult to control the reactions so as to selectively promote only one of the reactions, and colored images with a high contrast are difficult to obtain.

Japanese Unexamined Patent Publications No. 5-124,360 and No. 6-210,954 disclose a system using, as a color-developing agent, a phosphoric acid compound or phenol compound each having a long chain alkyl group. This system is, however, disadvantageous in that the colored images may be not fully erased and the storage property of the colored images may be insufficient.

Further, when the reversible thermosensitive recording material is subjected to repeated color-developing and color-erasing procedures, the thermosensitive recording layer may be separated from the support material of the recording material, or may be cracked so that the resultant quality of the images is degraded.

To solve the above-mentioned problems, Japanese Unexamined Patent Publication No. 6-344,672 and No. 6-344,673 provide a method of coating a reversible thermosensitive recording layer comprising, as a color-developing agent, a phenol compound having the above-mentioned long chain alkyl group with an overcoat layer cured by an electron beam irradiation. The overcoat layer protects the thermosensitive recording layer and contributes to increasing the repeatable number of the color-developing and color-erasing procedures. However, the storage stability of the resultant colored images is insufficient.

As mentioned above, although various types of reversible thermosensitive recording material have been disclosed, each of them has various disadvantages. Therefore, no reversible thermosensitive recording material having a practically satisfactory performance has been obtained.

DISCLOSURE OF THE INVENTION

The present invention is intended to provide a thermosensitive reversible recording material capable of recording colored images on a white ground, of effecting color-development and color-erasure of the images only due to difference in heating conditions and of forming colored images having a high contrast, the colored images having an excellent storage property.

The inventors of the present invention have made extensive studies focused on a dye-type thermosensitive reversible recording system in which a reaction between a dye and a color-developing agent is utilized, to provide a thermosensitive reversible recording material capable of reversibly forming and erasing colored images thereon only by heating, of exhibiting a high contrast between the color-developed portions and the color-erasure portions, and of repeatedly effecting the reversible heat-color-development and color-erasion. As a result of the study, it was found that the target thermosensitive reversible recording material can be obtained by using, as a color-developing agent, a non-phenolic, sulfonylurea compound having a long chain alkyl group. The present invention was completed on the basis of this finding.

The thermosensitive reversible recording material of the present invention comprises a substrate sheet, and a thermosensitive recording layer formed on the substrate sheet and comprising a colorless or light colored dye precursor and a color-developing agent capable of reversible color-developing and erasing the dye precursor, characterized in that the color-developing agent comprises at least one aromatic compound of the general formula (1):

(1)

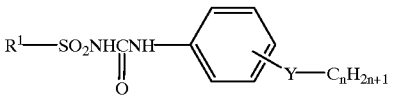

wherein $R^1$ represents a member selected from the class consisting of a naphthyl group, and a phenyl group substituted with at least one lower alkoxy group, and Y represents a member selected from the class consisting of divalent groups of the formulae:

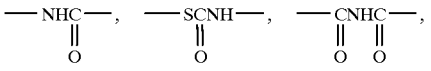

-continued

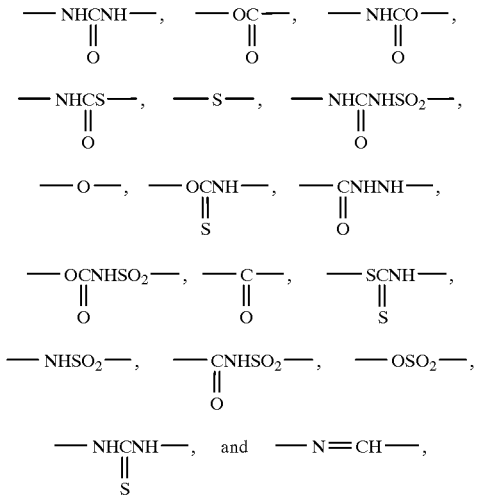

and n represents an integer of 11 to 30.

In the thermosensitive reversible recording material of the present invention, the thermosensitive recording layer is preferably coated with an overcoat layer comprising, as a principal component, a polymeric material, and the polymeric material is preferably an electron beam- or ultraviolet ray-cured product of an organic unsaturated compound capable of being cured by irradiation by an electron beam or ultraviolet rays.

In the thermosensitive reversible recording material of the present invention, an intermediate barrier layer comprising, as a principal component, a film-forming polymeric material may be formed between the above-mentioned thermosensitive recording layer and the above-mentioned overcoat layer.

BEST MODE OF CARRYING OUT THE INVENTION

Figure 1:
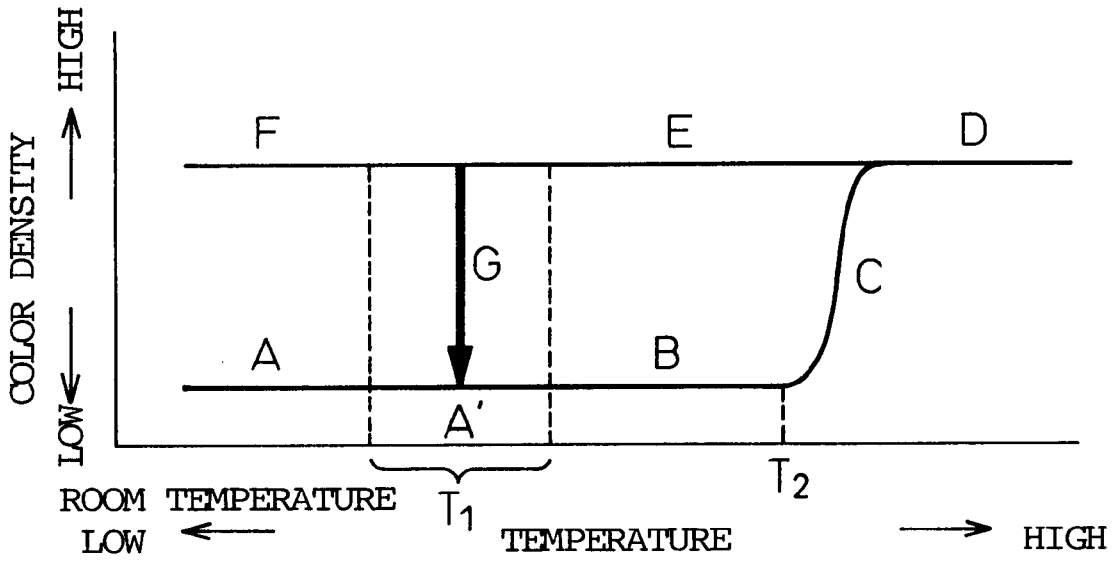
FIG. 1 is a graph showing a relationship between temperature and color density in the color-developing and color-erasing procedure cycle of the thermosensitive reversible recording material of the present invention.

In the thermosensitive reversible recording material, the thermosensitive recording layer comprising a dye precursor and a color-developing agent rapidly form a color upon heating, and the resultant color is maintained at room temperature by rapidly cooling the thermosensitive recording layer. Also, the colored images maintained at the room temperature can be erased by heating to a temperature equal to or lower than the color-forming temperature, and the erased image traces can be maintained even when they are cooled to the room temperature. Namely, to apply the reversible thermal color-developing and erasing procedures to the thermosensitive recording material of the present invention, it is possible that the colored images are color-developed and recorded by applying a heating procedure to the thermosensitive recording layer and after the record was completed, the colored images are erased by applying a heating procedure to the thermosensitive recording layer at a temperature lower than the heating temperature for the color-developing.

In the thermosensitive reversible recording material of the present invention, the color-developing and erasing mechanism is not clear. However, it is assumed that, in the color-developing compound of the formula (1), the urea moiety in the sulfonylurea group is activated by the sulfonyl moiety adjacent thereto and exhibits a high color-developing activity for a basic leuco dye, the color-development of the dye occurs, and when the color-formed material is heated to a temperature not higher than the color-developing temperature, the long chain alkyl groups (—$C_nH_{2n+1}$ groups) in the color-developing agent are orientated so as to induce a crystallization of the color-developing agent, and thus the dye is separated from the color-developing agent so as to make the color disappear.

Generally, the heating temperature for the color-development is 80° C. to 180° C., and the heating temperature for the color-erasion is in the range of 50 to 120° C. and lower than the heating temperature for the color-development. Generally, while the color-development is carried out by using a thermal head which is easy to rapidly cool after heating, the color-erasion is carried out by holding the material at a color-erasing temperature range lower than the color-developing temperature, and heating and cooling rates do not need to be controlled. The temperature holding time for the color-erasure is preferably 0.1 second or more.

The color-developing and erasing procedures will be explained in detail with reference to FIG. 1.

In FIG. 1, when a non-recorded recording material held in condition A is heated, the temperature of the recording material increases through condition B and the color density rapidly increases at a temperature $T_2$, and after passing through condition C, the color-developing reaction is completed and the recording material reaches condition D and exhibits a highest color density. When the material is rapidly cooled from the condition D to room temperature, the recording material passes through condition E and then reaches condition F. The condition F is a condition in which the developed color is maintained at room temperature and in the condition F, the recording of the images is completed. When the recorded images are heated and maintained in a temperature range $T_1$, the color density of the images gradually decreases, passed through condition G and reaches condition A' in which the colored images are completely erased. Further, the recording material is cooled to room temperature and reaches condition A. The condition A is a condition in which the color-erased condition is held at room temperature and the color-erasure is complete. The color-developing and erasing cycle is reversible and can thus be repeated.

In the thermosensitive reversible recording material of the present invention, the color-developing agent contained in the thermosensitive recording layer comprises at least one aromatic compound of the formula (1). In the formula (1), $R^1$ represents a naphthyl group or a phenyl group substituted with a lower alkoxy group, preferably alkoxyl group having 1 to 4 carbon atoms and is preferably selected from, for example, the groups of the formulae:

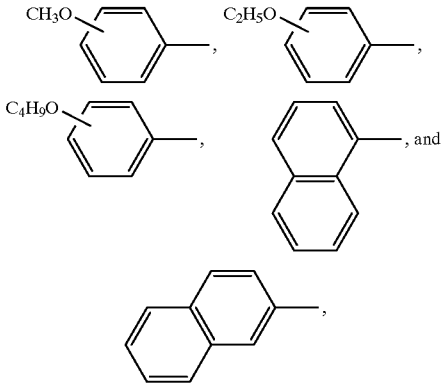

The long chain alkyl group (—$C_nH_{2n+1}$) in the compound of the formula (1) must has the number n of carbon atoms of 11 or more but not more than 30. The number n of carbon atoms in the long chain alkyl group is preferably 14 to 21. When the carbon atom number n of the long chain alkyl group is less than 11, the resultant color-developing agent exhibits an insufficient color-erasing property for practical use. Also, when the carbon atom number is more than 30, the resultant compound exhibit a reduced color-developing activity and thus is unsatisfactory in practice.

The aromatic color-developing compounds of the formula (1) may be employed alone or in a mixture of two or more thereof.

The above-mentioned aromatic compound of the formula (1) can be selected from those of the formulae (2) and (3):

(2)

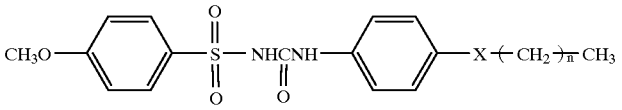

(3)

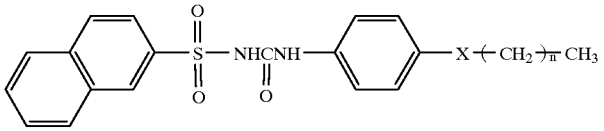

in which formulae (1) and (2), X represents a —NHCO—, —NHCOO— or —NHCOS— group, and n' represents an integer of 15 to 20.

The N-(p-methoxybenzenesulfonyl)-N'-phenyl urea compounds of the formula (2) include the following compounds.

N-(p-methoxybenzenesulfonyl)-N'-[4-(n-octadecanoylamino)phenyl]urea,

N-(p-methoxybenzenesulfonyl)-N'-[4-(n-eicosanoylamino)phenyl]urea,

N-(p-methoxybenzenesulfonyl)-N'-[4-(n-docosanoylamino)phenyl]urea,

N-(p-methoxybenzenesulfonyl)-N'-[4-(n-hexadecyloxycarbonylamino)phenyl]urea,

N-(p-methoxybenzenesulfonyl)-N'-[4-(n-eicosyloxycarbonylamino)phenyl]urea,

N-(p-methoxybenzenesulfonyl)-N'-[4-{(n-hexadecylthio)carbonylamino}phenyl]urea, and N-(p-methoxybenzenesulfonyl)-N'-[4-{(n-octadecylthio)carbonylamino}phenyl]urea.

The N-(2-naphthylsulfonyl)-N'-phenylurea compounds of the formula (3) include the following compounds.

N-(2-naphthylsulfonyl)-N'-[4-(n-octadecanoylamino)phenyl]urea,

N-(2-naphthylsulfonyl)-N'-[4-(n-eicosanoylamino)phenyl]urea,

N-(2-naphthylsulfonyl)-N'-[4-(n-docosanoylamino)phenyl]urea,

N-(2-naphthylsulfonyl)-N'-[4-(n-hexadecyloxycarbonylamino)phenyl]urea,

N-(2-naphthylsulfonyl)-N'-[4-(n-octadecyloxycarbonylamino)phenyl]urea,

N-(2-naphthylsulfonyl)-N'-[4-(n-eicosyloxycarbonylamino)phenyl]urea,

N-(2-naphthylsulfonyl)-N'-[4-{(n-hexadecylthio)carbonylamino}phenyl]urea, and

N-(2-naphthylsulfonyl)-N'-[4-{(n-octadecylthio)carbonylamino}phenyl]urea.

The aromatic compounds of the formula (1) include the compounds represented by the following chemical formulae.

| Chemical formula | Compound No. |
|---|---|
| 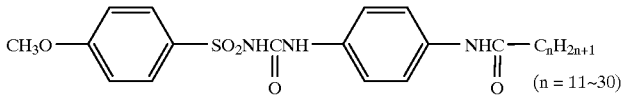 (n = 11~30) | 1 |
| 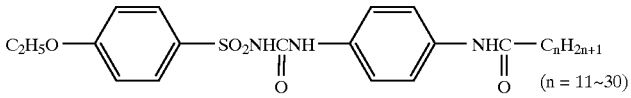 (n = 11~30) | 2 |
| 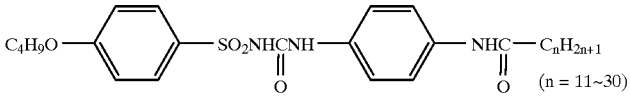 (n = 11~30) | 3 |
| 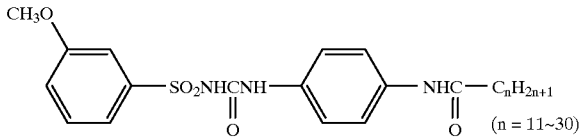 (n = 11~30) | 4 |
| 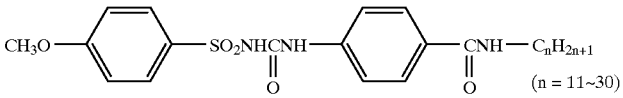 (n = 11~30) | 5 |
| 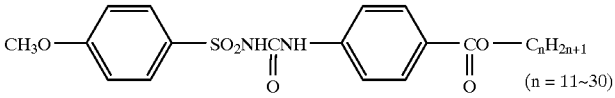 (n = 11~30) | 6 |
| 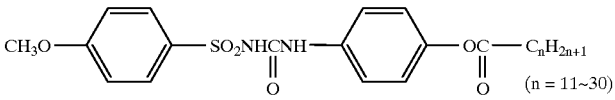 (n = 11~30) | 7 |
| 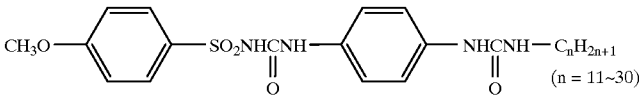 (n = 11~30) | 8 |
| 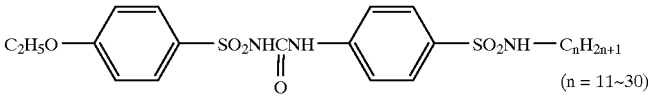 (n = 11~30) | 9 |

-continued
| Chemical formula | Compound No. |
|---|---|
| 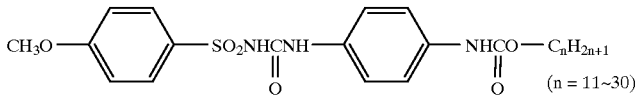 (n = 11~30) | 10 |
| 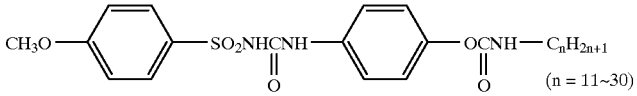 (n = 11~30) | 11 |
| 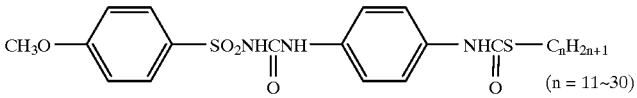 (n = 11~30) | 12 |
| 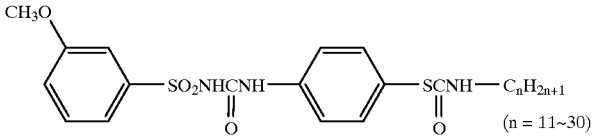 (n = 11~30) | 13 |
| 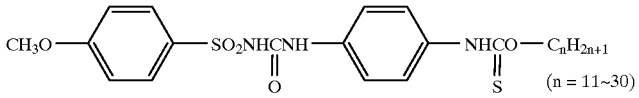 (n = 11~30) | 14 |
| 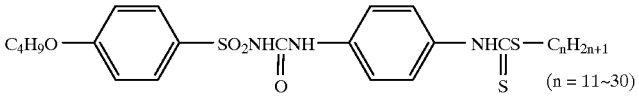 (n = 11~30) | 15 |
| 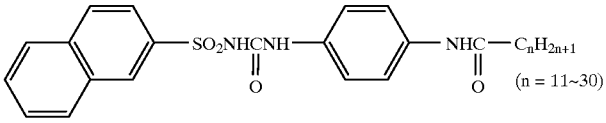 (n = 11~30) | 16 |
| 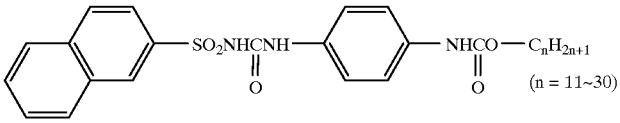 (n = 11~30) | 17 |
| 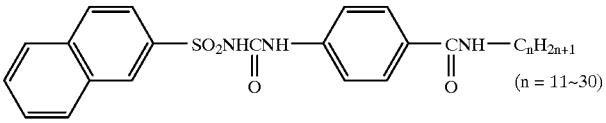 (n = 11~30) | 18 |
| 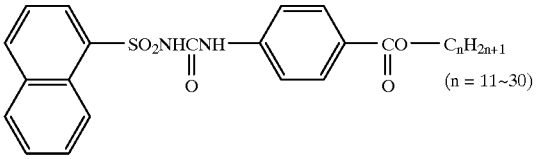 (n = 11~30) | 19 |
| 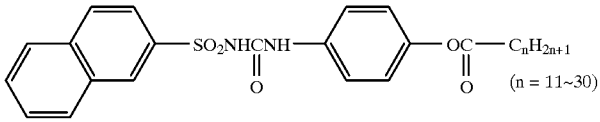 (n = 11~30) | 20 |

-continued
| Chemical formula | Compound No. |
|---|---|
| 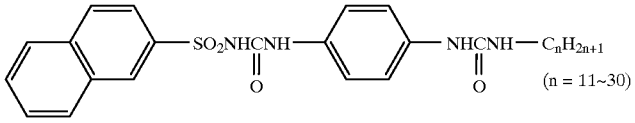 (n = 11~30) | 21 |
| 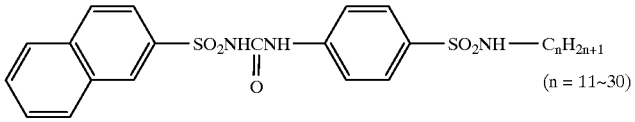 (n = 11~30) | 22 |
| 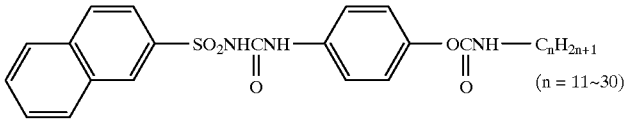 (n = 11~30) | 23 |
| 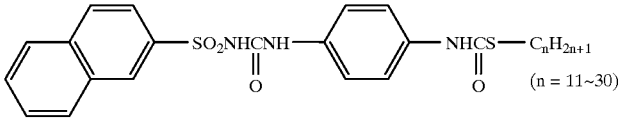 (n = 11~30) | 24 |
| 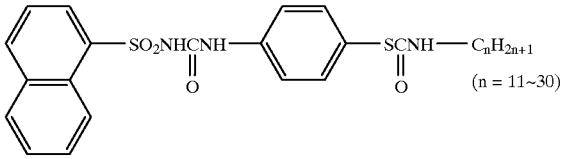 (n = 11~30) | 25 |
| 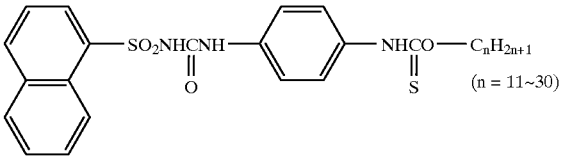 (n = 11~30) | 26 |
| 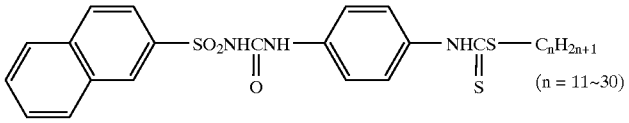 (n = 11~30) | 27 |
| 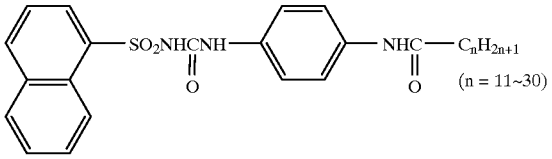 (n = 11~30) | 28 |
| 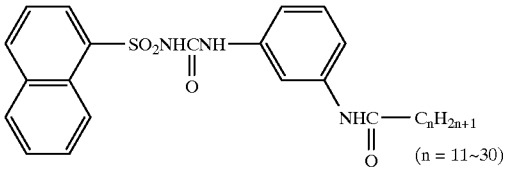 (n = 11~30) | 29 |

-continued

| Chemical formula | Compound No. |
|---|---|
| 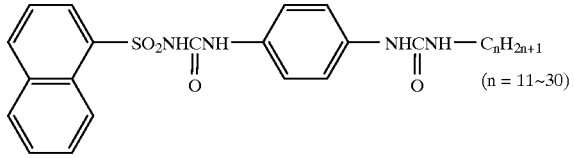 (n = 11~30) | 30 |
| 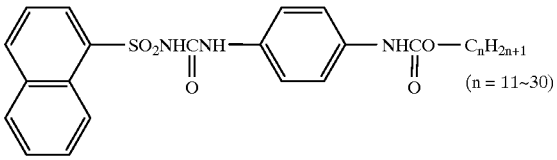 (n = 11~30) | 31 |
| 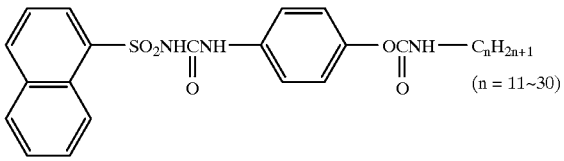 (n = 11~30) | 32 |

The aromatic compounds of the formula (1) usable for the present invention can be synthesized, for example, by the following reactions.

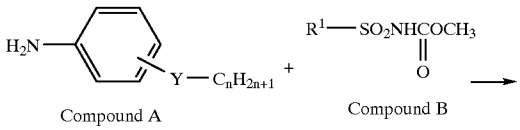

Compound A Compound B

Compound of the formula (1)

In the above-mentioned formula, $R^1$, Y and n are the same as defined above.

As a material compound (A) as mentioned above, the compounds of, for example, the following formulae can be employed.

(A-1)

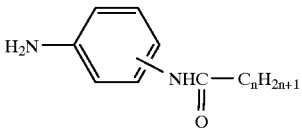

(A-2)

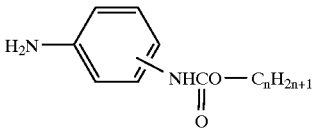

(A-3)

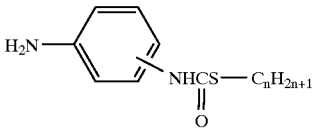

The compound (A-1) usable as a material compound for the above-mentioned reaction is obtained, for example, by synthesizing an anilide by a reaction of 4-nitroaniline with an acid chloride of a reactive long chain aliphatic carboxylic acid, and then reducing the nitro group to an amino group by a catalytic hydrogen-addition reaction. Also, the material compound (A-2) can be obtained, for example, by reducing N-(4-nitrophenyl) carbamic acid ester which is obtained by a reaction of 4-nitrophenyl isocyanate with a long chain aliphatic alcohol, by a catalytic hydrogen addition reaction. Further, the material compound (A-3) can be obtained, for example, by reducing N-(4-nitrophenyl) thiocarbamic acid S-ester which is obtained by a reaction of 4-nitrophenyl isocyanate with a long chain aliphatic thiol, with tin chloride under an acidic condition.

In the above-mentioned reaction, the compound (B) used as a material is selected from, for example, the following compounds.

(B-1)

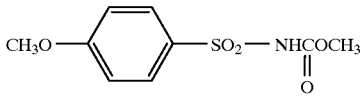

(B-2)

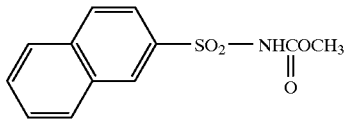

The material compound (B-1) can be produced, for example, by preparing a sodium salt of p-methoxybenzenesulfonamide by a reaction of p-methoxybenzenesulfonamide with sodium methylate in a lower aliphatic alcohol, reacting the p-methoxybenzenesulfonamide sodium salt with a carbonate compound represented by the following general formula:

$$(R_1O)_2CO$$

wherein $R_1$ represents an alkyl group having 1 to 4 carbon atoms or a phenyl group, to prepare a sodium salt of p-methoxybenzenesulfonylcarbamate, evaporating away the above-mentioned lower aliphatic alcohol from the resultant reaction mixture, dissolving the above-mentioned sodium salt in water, and neutralizing the resultant solution with an acid.

In the producing method of the material compound (B-2), for example, 2-naphthylsulfonamide is reacted with sodium carbonate in tetrahydrofuran to prepare a potassium salt of 2-naphthylsulfonamide, this compound is reacted with a chloroformate compound represented by the following general formula:

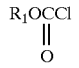

wherein $R_1$ represents an alkyl group with 1 to 4 carbon atoms or a phenyl group, to prepare a potassium salt of 2-naphthylsulfonylcarbamate, the above-mentioned tetrahydrofuran and an excessive fraction of the chloroformate compound are evaporated away from the reaction mixture. The above-mentioned potassium salt is dissolved in water added to the product, the resultant solution is neutralized with an acid.

There is no specific limitation to the reaction media for the reaction of the material compound (A) with the material component (B), unless the reaction medium reacts with the compound (B) (carbamate compound) so as to hinder the reaction between the compounds (A) and (B). Preferable reaction media include, for example, aliphatic halogen compounds, for example, dichloromethane, chloroform and carbon tetrachloride; aliphatic nitrile compounds, for example, acetonitrile and propionitrile; aliphatic esters, for example, ethyl acetate, propyl acetate and butyl acetate; aliphatic ethers, for example, diethylether, dibutylether, and ethyleneglycoldimethylether; and aliphatic ketones, for example, 2-butanone and cyclohexanone.

In the thermosensitive recording layer of the thermosensitive reversible recording material of the present invention, the compounds usable as the dye precursor include conventional triphenylmethane, fluoran and diphenylmethane compounds, and can be selected from these known compounds. The dye precursor compounds usable for the present invention include, for example, 3-(4-diethylamino-2-ethoxyphenyl)-3-(1-ethyl-2-methylindole-3-il)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o,p-dimethylanilino) fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino) fluoran, 3-diethylamino-7-(m-trifluoromethylanilino) fluoran, 3-diethylamino-6-methyl-7-chlorofluoran, 3-diethylamino-6-methylfluoran, 3-cyclohexylamino-6-chlorofluoran, 3-(N-ethyl-N-cyclohexyl)-6-methyl-7-(p-chloroanilino) fluoran, 3-di(n-pentyl)amino-6-methyl-7-anilinofluoran, 3-[N-(3-ethoxypropyl)-N-ethylamino]-6-methyl-7-anilinofluoran, 3-(N-n-hexyl-N-ethylamino)-7-(o-chloroanilino) fluoran, 3-(N-ethyl-N-2-tetrahydrofurfurylamino)-6-methyl-7-anilinofluoran, 3-(N-ethyl-N-isopentylamino)-6-methyl-7-anilinofluoran, 2,2-bis{4-[6'-(N-cyclohexyl-N-methylamino)-3'-methylspiro(phthalido-3,9'-xanthene]-2'-il amino]phenyl} propane and 3-dibutylamino-7-(o-chloroanilino) fluoran.

These dye precursory compound may be employed alone or in a mixture of two or more thereof.

In the present invention, the sulfonylurea color-developing agent may be employed together with a conventional color-developing agent comprising phenolic compounds, organic carboxylic acids and aromatic sulfonyl (thio) urea compounds having no long chain alkyl group, as long as the conventional color-developing agent does not obstruct the desired effect of the present invention.

The conventional color-developing agent may be selected from 2,2-bis(4-hydroxyphenyl)propane (bisphenol A), 1,1-bis(4-hydroxyphenyl)-1-phenylethane, 1,4-bis[1-methyl-1-(4'-hydroxylphenyl)ethyl]benzene, 1,3-bis[1-methyl-1-(4'-hydroxyphenyl)ethyl]benzene, dihydroxydiphenylether (Japanese Unexamined Patent Publication No. 1-180,382), benzyl p-hydroxy-benzoate (Japanese Unexamined Patent Publication No. 52-140,483), bisphenol S, 4-hydroxy-4'-isopropyloxydiphenylsulfone (Japanese Unexamined Patent Publication No. 60-13,852), 1,1-di-(4-hydroxyphenyl)-cyclohexane, 1,7-di(4-hydroxyphenylthio)-3,5-dioxaheptane (Japanese Unexamined Patent Publication No. 59-52,694), 3,3'-diallyl-4,4'-dihydroxydiphenyl-sulfone (Japanese Unexamined Patent Publication No. 60-208,286), N-(p-toluenesulfonyl)-N'-phenylurea, N-(p-toluenesulfonyl)-N'-p-methoxyphenyl)urea, N-(p-toluenesulfonyl)-N'-(o-tolyl)urea, N-(p-toluenesulfonyl)-N'-(m-tolyl)urea, N-(p-toluenesulfonyl)-N'-(p-tolyl)urea, N-(p-toluenesulfonyl)-N'-benzylurea (the above 6 compounds are disclosed in Japanese Unexamined Patent Publication (Kokai) No. 5-32,061), and 4,4'-bis(p-toluenesulfonylaminocarbonylamino)-diphenylmethane, 4,4'-bis(o-toluenesulfonylaminocarbonylamino) diphenylmethane, 4,4'-bis (benzenesulfonylaminocarbonylamino) diphenylmethane, 1,2-bis[4'-(p-toluenesulfonylaminocarbonylamino) phenyloxy]ethane, 4,4'-bis (ptoluenesulfonylaminocarbonylamino)diphenylether, and 3,3-bis(p-toluenesulfonylaminocarbonylamino) diphenylsulfone (the above 6 compounds are disclosed in Japanese Unexamined Patent Publication (Kokai) No. 5-147,357).

In the thermosensitive reversible recording material of the present invention, the thermosensitive recording layer optionally contains a heat-fusible substance which is commonly known as a sensitizing agent. The sensitizing agent may be selected from, for example, oxalic acid diesters (Japanese Unexamined Patent Publication No. 64-1,583), di(4-methylbenzyl) oxalate (Japanese Examined Patent Publication No. 5-62,597, 1,2-bis(m-tolyloxy) ethane (Japanese Unexamined Patent Publication No. 60-56,588), diphenylsulfone (Japanese Unexamined Patent Publication No. 60-15,667), and N-benzylbiphenyl (Japanese Unexamined Patent Publication No. 60-82,382). These compounds have such a performance that the color-development of the thermosensitive reversible recording material can be effected at an increased color density and further such a performance that the color-erasing reaction is promoted and the reversibility is enhanced.

In the present invention, the thermosensitive recording layer may further contain waxes and pigments in an amount which does not hinder the effect of the present invention.

The waxes may be selected from conventional waxes, for example, paraffins, amide-based waxes, bisimide-based waxes and metal salts of higher fatty acids. However, it is preferable that, since a zinc salt of a higher fatty acid contained, as a wax, in a large amount in the thermosensitive recording layer may cause the color-erasing effect to be decreased with increase in the repeating numbers of color-developing and erasing procedures, and the erasion of the colored images to be imperfect, the addition amount of the higher fatty acid zinc salt wax is 1% or less based on the total dry weight of the thermosensitive recording layer.

As the above-mentioned pigments, for example, inorganic fine particles, for example, silica, clay, calcined clay, talc, calcium carbonate, zinc oxide, titanium dioxide, aluminum hydroxide, zinc hydroxide, barium sulfate, and surface-treated calcium carbonate and silica fine particles; and organic fine particles, for example, urea-formaldehyde resin, styrene-methacrylic acid copolymer and polystyrene resin fine particles may be used.

The above-mentioned components of the thermosensitive recording layer of the thermosensitive reversible recording material of the present invention are bonded to the substrate sheet with a binder. For the binder, use may be made of water-soluble polymeric materials, for example, various types of polyvinyl alcohols which have different molecular weights from each other, starch and derivatives thereof, cellulose derivatives, for example, methoxy cellulose, carboxymethyl cellulose, methyl cellulose, ethyl cellulose, etc.; sodium polyacrylate, polyvinyl pyrrolidine, acrylic acid amide-acrylic acid ester copolymer, acrylic acid amide-acrylic acid estermethacrylic acid terpolymer, alkali metal salt of styrene-maleic anhydride copolymer, polyacrylamide, sodium alginate, gelatine, casein, and so on; and latexes of polyvinyl acetate, polyurethane, styrene-butadiene copolymer, polyacrylic acid, polyacrylic acid ester, vinyl chloride-vinyl acetate copolymer, polybutyl methacrylate, ethylene-vinyl acetate copolymer, styrene-butadiene-acrylic terpolymer, etc.

In the thermosensitive recording layer of the thermosensitive reversible recording material of the present invention, preferably the dye precursor is contained in a content of 5 to 40% by weight, the color-developing and agent is in a content of 5 to 50% by weight, based on the total dry weight of the thermosensitive recording layer. If the content of the color-developing agent is less than 5% by weight, the resultant thermosensitive recording layer may exhibit an unsatisfactory color-developing performance. Also, when the content is more than 50% by weight, the color-developing performance may be saturated, the contrast between the color density in the color-developed condition and that in the color-erasing condition may not be specifically enhanced, and thus an economical disadvantage may occur.

Also, generally, the content of the sensitizing agent is preferably 5 to 50% based on the dry weight of the thermosensitive recording layer. When the content of the sensitizing agent is less than 5% by weight, the color-erasion-promoting effect may be insufficient, and when the content is more than 50% by weight, the color density of the colored images may be insufficient.

When waxes and pigments are contained in the thermosensitive recording layer, the contents thereof are preferably 5 to 20% by weight, more preferably 10 to 50% by weight, respectively. Also, the content of the binder is 5 to 20% by weight in general.

The substrate sheet usable for the thermosensitive reversible recording material is selected from paper sheets (including acidic and neutral paper sheets), coated paper sheets produced by coating a pigment or latex on the surface thereof, laminate paper sheets, synthetic paper sheets produced from, for example, a polyolefin resin, plastic films, for example, polyolefin, polyester and polyimide films, glass plates and electroconductive rubber sheets, which are usually used for the conventional thermosensitive recording sheets. On at least one surface of the substrate sheet, a coating liquid containing the above-mentioned necessary components is coated and dried to provide a thermosensitive reversible recording material. The thermosensitive recording layer is preferably in an amount of 1 to 15 g/m$^2$, more preferably 2 to 10 g/m$^2$ on a dry basis.

In the thermosensitive reversible recording material of the present invention, optionally, an undercoat layer is formed between the thermosensitive reversible colored image-forming layer and the substrate sheet.

Also, on a back surface of the thermosensitive reversible recording material of the present invention, a back layer may be formed to prevent a blocking phenomenon occurred when surfaces of the recording materials are brought into contact with each other, to restrict the penetration of water and oily substances through the back surface, and to control the curling of the recording material.

In the thermosensitive reversible recording material of the present invention, when the color-developing and erasing procedures are repeatedly applied to the thermosensitive recording layer, the thermosensitive recording layer may be cracked, and/or the thermosensitive recording layer may be separated from the substrate sheet, so as to decrease the quality of the recorded images. The number of times the color-developing and erasing procedures can be carried out without decreasing the quality of the recorded images (which number will be referred to as repeating durability hereinafter) is variable depending on the use. Generally, the repeating durability is preferably 30 times or more.

In an embodiment of the thermosensitive reversible recording material of the present invention, the thermosensitive recording layer is coated with an overcoat layer comprising a polymeric material as a principal component. The polymeric material is preferably a curing product of an electron beam or ultraviolet-ray curable organic unsaturated compound by irradiation of electron beam or ultraviolet rays. In the above-mentioned overcoat layer, the principal component thereof consisting of a resin is three dimensionally cross-linked in the curing procedure by irradiation with an electron beam or ultraviolet rays, and thus the resultant overcoat layer has a very high mechanical strength and heat resistance in comparison with those of the conventional overcoat layer formed from a non-cross-linked resin, for example, polyvinyl alcohol. Therefore, when heat, pressure and shearing stress are applied to the thermosensitive reversible recording material provided with the overcoat layer by a thermal head for color-developing and by a heating plate for color-erasing, the overcoat layer can protect the thermosensitive recording layer and prevent the cracking and peeling of the thermosensitive recording layer.

The organic unsaturated compounds curable by an electron beam or ultraviolet rays and usable for the overcoat layer of the thermosensitive reversible recording material of the present invention, can be selected from, for example, the following groups of compounds.

(1) acrylate and methacrylate compounds of aliphatic alcohols, cycloaliphatic alcohols, aromatic moiety-containing aliphatic alcohols, and polyalkylene glycols;

(2) acrylate and methacrylate compounds of addition reaction products of aliphatic, cycloaliphatic and aromatic moiety-containing aliphatic alcohols with alkyleneoxides;

(3) polyacryloyl and polymethacryloyl alkylphosphate esters;

(4) reaction products of polybasic acids with polyols and at least one member selected from the group consisting of acrylic acid and methacrylic acid;

(5) reaction products of isocyanate with polyols and at least one member selected from the group consisting of acrylic acid and methacrylic acid;

(6) reaction products of epoxy compounds with at least one member selected from the group consisting of acrylic acid and methacrylic acid; and (7) reaction products of epoxy compounds with polyols and at least one member selected from the group consisting of acrylic acid and methacrylic acid.

Examples of the organic unsaturated compounds of the above-mentioned groups (1) to (7) are polyurethane acrylates having a polybutadiene skeleton, polyurethane acrylates having a hydrogenated polybutadiene skeleton, polyurethane acrylates having a polyolefin skeleton, polyurethane acrylates having a hydrogenated recinol (hardened ricinous oil) skeleton, alkyl acrylates (for example, methyl acrylate, ethyl acrylate, lauryl acrylate, stearyl acrylate and 2-ethylhexyl acrylate), N-vinyl pyrrolidone, N-acryloylmorpholine, 2-hydroxyalkyl(meth) acrylates (for example, 2-hydroxyethyl acrylate, 2-hydroxyethyl methacrylate, 2-hydroxypropyl acrylate, 2-hydroxypropyl methacrylate, 2-hydroxybutyl acrylate, and 2-hydroxybutyl methacrylate), tetrahydrofurfuryl acrylate, tetrahydrofurfuryl methacrylate, caprolactone-modified tetrahydrofurfuryl acrylate, cyclohexyl acrylate, cyclohexyl methacrylate, dicyclohexyl acrylate, isobornyl acrylate, isobornyl methacrylate, benzyl acrylate, benzyl methacrylate, ethoxydiethyleneglycol acrylate, methoxytriethyleneglycol acrylate, methoxypropyleneglycol acrylate, phenoxypolyethyleneglycol acrylate, phenoxypolypropyleneglycol acrylate, nonylphenoxypolyethyleneglycol acrylate, ethyleneoxide-modified phenoxyacrylate nonylphenoxypolypropyleneglycol acrylate, N,N-dimethylaminoethylacrylate, N,N-dimethylaminoethyl methacrylate, 2-ethylhexylcarbitol acrylate, ω-carboxypolycaprolactone monoacrylate, monohydroxyethyl phthalate acrylate, acrylic acid dimer, 2-hydroxy-3-phenoxypropyl acrylate, and dicyclopentenyl acrylate.

Further, the electron-beam or ultraviolet-ray curable organic unsaturated compounds usable for the present invention include 9,10-epoxidized oleyl acrylate, 9,10-epoxidized oleyl methacrylate, ethyleneglycol maleate monoacrylate, dicyclopentanyl acrylate, dicyclopentenyloxyethylene acrylate, acrylates of adducts of 4,4-dimethyl-1,3-dioxolane with caprolactone, acrylates of adducts of 3-methyl-5,5-dimethyl-1,3-dioxolane with caprolactone, polybutadiene acrylate, ethyleneoxide-modified phenoxidized phosphoric acid acrylate, ethanediol diacrylate, ethanediol dimethacrylate, 1,3-propanediol diacrylate, 1,3-propanediol dimethacrylate, 1,4-butanediol diacrylate, 1,4-butanediol dimethacrylate, 1,6-hexanediol diacrylate, 1,6-hexanediol dimethacrylate, 1,9-nonanediol diacrylate, 1,9-nonanediol metharylate, 1,14-tetradecanediol diacrylate, 1,15-pentadecanediol diacrylate, diethyleneglycol diacrylate, polyethyleneglycol diacrylate, polyethyleneglycol dimethacrylate, dipropyleneglycol monoacrylate, polypropyleneglycol diacrylate, polypropyleneglycol dimethacrylate, and neopentylglycol diacrylate.

Further, the organic unsaturated compounds usable for the present invention include 2-butyl-2-ethylpropanediol diacrylate, ethyleneoxide-modified bisphenol A diacrylate, polyethyleneoxide-modified bisphenol A diacrylate, polyethyleneoxide-modified bisphenol A diacrylate, propyleneoxide-modified bisphenol A diacrylate, polypropyleneoxide-modified bisphenol A diacrylate, neopentylglycol hydroxypivalate diacrylate, diacrylates of adducts of neopentylglycol hydroxypivalate with caprolactone, ethyleneoxide-modified isocyanuric acid diacrylate, pentaerythritol diacrylate monostearate, and adducts of 1,6-hexanediol diglycidylether with acrylic acid.

Further, the organic unsaturated compounds usable for the present invention include polyoxyethyleneepichlorohydrin-modified bisphenol A diacrylate, tricyclodecanedimethanol diacrylate, trimethylolpropane triacrylate, ethyleneoxide-modified trimethylolpropane triacrylate, polyethyleneoxide-modified trimethylolpropane triacrylate, propyleneoxide-modified trimethylolpropane triacrylate, propyleneoxide-modified trimethylolpropane triacrylate, polypropyleneoxide-modified trimethylolpropane triacrylate, pentaerythritol triacrylate, ethyleneoxide-modified isocyanuric acid triacrylate, ethyleneoxide-modified glycerol triacrylate, polyethyleneoxide-modified glycerol triacrylate, propyleneoxide-modified glycerol triacrylate, polypropyleneoxide-modified glycerol triacrylate, pentaerythritol tetraacrylate, ditrimethylolpropane tetraacrylate, dipentaerythritol tetraacrylate, dipentaerythritol pentaacrylate, dipentaerythritol hexaacrylate, caprolactone-modified dipentaerythritol hexaacrylate, and polycaprolactone-modified pentaerythritol hexaacrylate.

These organic unsaturated compounds may be employed alone or in a combination of two or more thereof. When the ultraviolet ray-curable organic unsaturated compounds are employed, a photo-initiator is also preferably used. Examples of the photo-initiators are acetophenone, benzophenone, benzoinether, chloroacetophenone, diethoxyacetophenone, hydroxyacetophenone, α-aminoacetophenone, benzylmethylhetal, tioxanthone, α-acyloxime ester, acylphosphine oxide, glyoxyester, 3-ketocumarin, 2-ethylanthraquinone, camphorquinone, benzyl and Michler's ketone. Generally, the photo-initiator is used in an amount of 0.1 to 10% based on the weight of the organic unsaturated compounds.

The overcoat layer for the present invention may contain a pigment for the purpose of preventing sticking in the printing procedure. The pigments usable for the purpose include, for example, calcium carbonate, titanium dioxide, aluminum oxide, silicon dioxide, aluminum hydroxide, barium sulfate, talc, kaolin, clay, calcined clay, colloidal silica, styrene microball, nylon powder, polyethylene powder, and crude starch powder and surface coating and surface-treating products of the above-mentioned pigments with a member selected from fluorine-containing compounds, silicons, waxes, higher fatty acids, organic titanates, silane-coupling agents, high molecular resin compounds, organic acids and inorganic acids.

Also, the overcoat layer for the present invention may contain a higher fatty acid metal salt, for example, zinc stearate, magnesium stearate, calcium stearate or barium stearate, or a wax, for example, a paraffin, amide-based wax or bisimide-based wax, for the purpose of preventing sticking or head abrasion.

The content of the pigment in the overcoat layer is preferably 5 to 80% by weight, and the content of the wax is preferably 1 to 20% by weight.

To disperse the pigment in the organic unsaturated compound, a two roll mill, Cowless dissolver, homomixer, sand grinder, planetary mixer or ultrasonic disperser can be used.

As a coating method for the overcoat layer containing an organic unsaturated compound curable by electron beam or ultraviolet rays, for example, a bar coating method, blade coating method, squeeze coating method, air knife coating method, roll coating method, gravure coating method or transfer coating method can be used. Also, for the coating, a fountain coater or slit die coater system can be used.

Preferably, the overcoat layer for the present invention is in an amount of 1 to 30 g/m$^2$, more preferably 1.5 to 10 g/m$^2$.

The electron beam accelerater for the electron beam irradiation is not limited to a specific type of accelerater, and can be selected from, for example, a handie-graph type scanning system, a double scanning system, and a curtain beam system electron beam irradiation apparatuses. Among them, the curtain beam system which is relatively cheap and can generate a large output is advantageously used. In the electron beam irradiation, preferably, the accelerating voltage is 100 to 300 kV and the absorption dose is 0.1 to 6 Mrad.

The atmosphere for the electron beam irradiation preferably has an oxygen concentration of 500 ppm or less. When the oxygen concentration is more than 500 ppm, the oxygen may serve as a retarding agent for the polymerization reaction, and thus the curing of the electron beam-curable resin may become insufficient.

When the coating layer of the organic unsaturated compound is cured by an irradiation of ultraviolet rays, an ultraviolet ray-irradiation apparatus having a high pressure mercury lamp, a xenon lamp and a metal halide lamp is used as a beam source, and the beam amount and the arrangement of the beam source can be established in response to necessity.

In another embodiment of the thermosensitive reversible recording material of the present invention, an intermediate barrier layer comprising, as a main component, a film-forming polymer is formed between the thermosensitive recording layer and the overcoat layer. The film-forming resin may be a water-soluble polymer or a water-insoluble polymer.

The coating liquid containing the organic unsaturated compound curable by electron beam or ultraviolet rays and usable for the formation of the overcoat layer for the present invention may penetrate into the thermosensitive recording layer in the coating procedure of the coating liquid, and thus the organic unsaturated compound contained therein may deteriorate the storage stability and color-erasing property of the images in the thermosensitive recording layer. This disadvantage can be prevented by arranging the intermediate barrier layer comprising, as a main component, the film-forming polymer between the thermosensitive recording layer and the overcoat layer.

The water-soluble polymer usable for the formation of the intermediate barrier layer for the present invention may be selected from various polyvinyl alcohols different in molecular weight thereof, starch and derivatives thereof, cellulose derivatives, for example, methoxycellulose, carboxymethylcellulose, methylcellulose and ethylcellulose, polyacrylic acid sodium salt, polyvinyl pyrrolidone, acrylic acid amide/acrylic acid ester copolymers, acrylic acid amide/acrylic acid ester/methacrylic acid terpolymers, alkali metal salts of styrene/maleic anhydride copolymers, polyacrylamide, sodium alginate, gelatine and casein. Also, the water-insoluble polymer may be selected from polyvinyl acetate, polyurethanes, styrene/butadiene copolymers, polyacrylic acid, polyacrylic acid esters, vinyl chloride/vinyl acetate copolymers, polybutyl methacrylate, ethylene/vinyl acetate copolymers, and styrene/butadiene/acrylic copolymers, which may be in the state of a latex or emulsion.

In the present invention, the intermediate barrier layer may contain a pigment, and the pigment may be selected from inorganic fine particles, for example, calcium carbonate, silica, titanium dioxide, aluminum hydroxide, barium sulfate, clay, calcined clay, talc and surface-treated calcium carbonate and silica; and organic fine particles, for example, urea-formaldehyde resins, styrene/methacrylic acid copolymers and polystyrene resins.

The content of the pigment contained in the intermediate barrier layer is preferably 5 to 80% by weight based on the dry weight of the intermediate barrier layer. When the content of the pigment is less than 5% by weight, the viscosity of the intermediate barrier layer is excessively reduced and the coating property thereof is decreased. Also, if the pigment is used in an amount more than 80% by weight, the content of the film-forming polymer contained in the intermediate barrier layer becomes too small, and thus the adhesion between the thermosensitive recording layer and the overcoat layer becomes insufficient.

The dry coating amount of the intermediate barrier layer is preferably 1 to 30 g/m$^2$ more preferably 1.5 to 10 g/m$^2$.

The above-mentioned intermediate barrier layer may be utilized as an overcoat layer without forming the overcoat layer thereon.

In the present invention, to enhance the added value of the thermosensitive reversible recording material, the material may be further processed to impart an enhanced function thereto. For example, by applying a coating with a pressure-sensitive adhesive, a rewetting adhesive or a delayed tack adhesive to the back surface of the thermosensitive reversible recording material, a pressure-sensitive adhesive sheet, rewet adhesive sheet or delayed tack sheet can be obtained. Also, by applying a magnetic treatment to the back surface, a thermosensitive reversible recording material capable of magnetic recording can be obtained. Also, a function as a thermal transfer sheet, ink jet recording sheet, non-carbon recording sheet, static recording sheet or xerographic recording sheet may be imparted to the back surface of the reversible recording material, to provide a recording sheet capable of recording on two surfaces thereof. Of course, a two surface reversible recording material can be obtained.

The heating means for color-developing and erasing can be selected, in response to the purpose of use, from thermal head, constant temperature bath, heating roller, heating pen, facing heat-generating element, laser beam and infrared rays. However, the heating means are not limited to the above-mentioned ones.

EXAMPLES

The present invention will be further explained by the following examples.

In the examples, the terms "part" and "%" refer to "part by weight" and "% by weight", respectively, unless specifically indicated.

Synthesis Example 1

Synthesis of methyl(p-methoxybenzenesulfonyl) carbamate

In a three necked flask equipped with a dropping funnel, a thermometer and a reflux condenser, methanol (264 g) was mixed with p-methoxybenzenesulfonamide (262 g) and a methanol solution (379 g) of 30% sodium methylate, the resultant mixture was stirred. Thus the p-methoxybenzenesulfonamide is dissolved and a sodium salt thereof is produced by an exothermic reaction.

Then, the resultant reaction mixture was added with dimethyl carbonate (152 g) and subjected to a reaction under reflux for 18 hours. After the reaction was completed, the reaction mixture was analysed by high speed liquid chromatography. In the result, the conversion of the p-methoxybenzenesulfonamide was 98%. Next, the inside temperature of the reactor was maintained at 50° C. or less to distill away methanol and an excessive fraction of dimethyl carbonate. A sodium salt of methyl(p-methoxybenzenesulfonyl)carbamate was obtained. To the resultant compound, water (1000 ml) was added, to dissolve the sodium salt therein, the resultant solution was added with hydrochloric acid (230 g) to adjust the pH value of the solution to 2. Methyl(pmethoxybenzenesulfonyl)carbamate was precipitated in an amount of 323 g. The precipitate in an amount of 323 g was obtained and the yield thereof was 94%.

Synthesis Example 2

Synthesis of N-(p-methoxybenzenesulfonyl)-N'-[4-(n-octadecanoylamino)phenyl]urea (Compound No. 1, in which n=17)

In a three necked flask equipped with a dropping funnel, a thermometer and a reflux condenser, p-nitroaniline (138 g) was dissolved in a mixed solution of tetrahydrofuran (200 ml) and pyridine (140 ml) in a nitrogen atmosphere. Then, octadecanoyl chloride (333 g) was added dropwise into the three necked flask through the dropping funnel, over a time span of 20 minutes while stirring the reaction mixture. After the completion of the dropping, the reaction mixture was stirred for 2 hours. Then, a solid product was produced. The solid product was filtered and the filtrate was concentrated under a reduced pressure to provide crystals. The crystals were collected and recrystallized from ethanol. 4'-nitro-n-octadecaneanilide (364 g) was obtained. The yield thereof was 90%.

The crystals were dissolved in tetrahydrofuran (8000 ml), added with 5% palladium carbon (95 g), and vigorously stirred in a hydrogen atmosphere under a pressure of 3 atmospheres.

After the completion of the reaction, palladium carbon was removed by filtering, and then the solvent was removed under a reduced pressure, to produce crystals. The crystals were collected and recrystallized from ethanol to obtain 4'-amino-n-octadecaneanilide (300 g). The yield thereof was 89%.

The crystals were suspended in toluene (6000 ml) and the methyl(p-methoxybenzenesulfonyl)carbamate (206 g) of Synthesis Example 1 was added to the suspension while stirring the suspension, and refluxed for 5 hours. The reaction liquid was cooled to room temperature while crystals were precipitated. The crystals were collected by filtering under reduced pressure. The crystals were washed with acetonitrile and dried under reduced pressure. The target product (396 g) was obtained at a yield of 84%.

The analysis results of the crystals were as follows.

Melting temperature: 188° C.; $^1$H-NMR measurement results in ppm (in denterated methylsulfoxide); δ=0.85 (t, 3H), 1.23 (br.s, 28H), 1.52–1.56 (m, 2H), 2.24 (t, 2H), 3.83 (s, 3H), 7.13 (d, 2H), 7.22 (d, 2H), 7.45 (d, 2H), 7.88 (d, 2H), 8.69 (s, 1H), 9.77 (s, 1H); IR measurement results (KBr tablet method); 3300, 2920, 2850, 1692, 1665, 1552, 1520, 1451, 1405, 1160 cm$^{-1}$ Synthesis Example 3

Synthesis of N-(p-methoxybenzenesufonyl)-N'-[4-(n-eicosanoylamino)phenyl]urea (Compound No. 1 wherein=19)

In a three necked flask equipped with a dropping funnel, a thermometer and a reflux condenser, p-nitroaniline (138 g) was dissolved in a mixed solution of tetrahydrofuran (200 ml) and pyridine (140 ml) in a nitrogen atmosphere. Eicosayl chloride (364 g) was entered dropwise into the three necked flask through the dropping funnel over a time span of 20 minutes, while stirring the reaction mixture. After the completion of the dropping, the reaction mixture was stirred for 2 hours, to produce a solid product. The solid product was removed by filtering and the filtrate was concentrated under reduced pressure to produce crystals. The crystals were collected and recrystallized from ethanol to obtain 4'-nitro-n-eicosaneanilide (355 g) at a yield of 82%.

The crystals were dissolved in tetrahydrofuran (10000 ml), added with a 5% palladium carbon (87 g) and vigorously stirred in a hydrogen atmosphere under a pressure of 3 atmospheres.

After the completion of the reaction, the palladium carbon was removed by filtering and the solvent was removed under reduced pressure to obtain crystals. The crystals were collected and recrystallized from ethanol, to obtain 4'-amino-n-eicosaneanilide (265 g) at a yield of 80%.

The crystals were suspended in toluene (5000 ml), methyl (p-methoxybenzenesulfonyl)carbamate (170 g) of Synthesis Example 1 was added to the suspension, and the mixture was heat-refluxed for 5 hours while stirring the mixture. When the reaction liquid was cooled to room temperature, white crystals were produced. The crystals were collected by filtering under reduced pressure. The crystals were washed with acetonitrile and dried under reduced pressure. The target product (356 g) was obtained at a yield of 88%.

The analysis results of the resultant product are as follows.

Melting temperature: 183° C.; $^1$H-NMR measurement results in ppm (in denterated methylsulfoxide); δ=0.85 (t, 3H), 1.23 (br.s, 32H), 1.52–1.56 (m, 2H), 2.24 (t, 2H), 3.83 (s, 3H), 7.13 (d, 2H), 7.22 (d, 2H), 7.45 (d, 2H), 7.88 (d, 2H), 8.69 (s, 1H), 9.77 (s, 1H); IR measurement results (in KBr tablet method); 3300, 2920, 2850, 1692, 1665, 1555, 1520, 1450, 1408, 1162 cm$^{-1}$ Synthesis Example 4

Synthesis of N-(p-methoxybenzenesufonyl)-N'-[4-(n-docosanoylamino)phenyl]urea (Compound No. 1 wherein n=21)

In a three necked flask equipped with a dropping funnel, a thermometer and a reflux condenser, p-nitroaniline (138 g) was dissolved in a mixed solution of tetrahydrofuran (200 ml) and pyridine (140 ml) in a nitrogen atmosphere. Docosayl chloride (395 g) was added dropwise into the three necked flask through the dropping funnel over a time span of 20 minutes, while stirring the reaction mixture. After the completion of the dropping, the reaction mixture was stirred for 2 hours, to produce a solid product. The solid product was removed by filtering and the filtrate was concentrated under reduced pressure to produce crystals. The crystals were collected and recrystallized from ethanol to obtain 4'-nitro-n-docosaneanilide (405 g) at a yield of 88%.

The crystals were dissolved in tetrahydrofuran (12000 ml), added with a 5% palladium carbon (92 g) and vigorously stirred in a hydrogen atmosphere under a pressure of 3 atmospheres. After the completion of the reaction, the palladium carbon was removed by filtering and the solvent was removed under reduced pressure to obtain crystals. The crystals were collected and recrystallized from ethanol, to obtain 4'-amino-n-docosaneanilide (322 g) at a yield of 80%.

The crystals were suspended in toluene (6000 ml), methyl (p-methoxybenzenesulfonyl)carbamate (193 g) of Synthesis Example 1 was added to the suspension, and the mixture was heat-refluxed for 5 hours while stirring the mixture. When the reaction liquid was cooled to room temperature, white crystals were produced. The crystals were collected by filtering under reduced pressure. The crystals were washed with acetonitrile and dried under reduced pressure. The target product (429 g) was obtained at a yield of 89%.

The analysis results of the resultant product are as follows.

Melting temperature: 188° C.; $^1$H-NMR measurement results in ppm (in denterated methylsulfoxide); δ=0.85 (t, 3H), 1.23 (br.s, 36H), 1.52–1.56 (m, 2H), 2.24 (t, 2H), 3.83 (s, 3H), 7.13 (d, 2H), 7.22 (d, 2H), 7.45 (d, 2H), 7.88 (d, 2H), 8.69 (s, 1H), 9.77 (s, 1H); IR measurement results (in KBr tablet method); 3300, 2920, 2850, 1692, 1665, 1555, 1520, 1450, 1408, 1162 cm$^{-1}$ Synthesis Example 5

Synthesis of N-(p-methoxybenzenesulfonyl)-N'-[4-(n-hexadecyloxycarbonylamino)phenyl]urea (Compound No. 10 wherein n=16)

In a three necked flask equipped with a dropping funnel, a thermometer and reflux condenser, p-hexadecanol (155 g) was dissolved in toluene (1250 ml) in a nitrogen atmosphere. To the solution, p-nitrophenyl isocyanate (100 g) was gradually added, stirred at room temperature for 10 minutes, and then refluxed for 30 minutes. The reaction mixture was cooled to room temperature to allow crystals to precipitate. The crystals were collected by filtering and washed with toluene, to obtain n-hexadecyl p-nitrophenylcarbamate (240 g) at a yield of 97%.

The crystals were dissolved in tetrahydrofuran (4800 ml) and added with a 5% palladium carbon (38 g) and the mixture was vigorously stirred in a hydrogen atmosphere under a pressure of 3 atmospheres for 2 hours. After the reaction was completed, the palladium carbon was removed by filtering, and the solvent was removed under reduced pressure, to produce crystals. The crystals were collected, and recrystallized from ethanol, to obtain n-hexadecyl p-aminophenylcarbamate (189 g) at a yield of 85%.

The crystals were suspended in toluene (4000 ml) and added with methyl(p-methoxybenzenesulfonyl)carbamate (129 g) of Synthesis Example 1, while stirring the mixture, and the mixture was refluxed for 5 hours. The reaction mixture was cooled to room temperature to allow white crystals to precipitate. The crystals were collected by filtering under reduced pressure. The crystals were washed with acetonitrile and dried under reduced pressure. The target product (269 g) was obtained at a yield of 91%.

The analysis results of the crystals are as follows.

Melting temperature: 185° C.; $^1$H-NMR measurement results in ppm (in denterated methylsulfoxide) δ=0.85 (t, 3H), 1.22 (br.s, 26H), 1.57–1.60 (m, 2H), 3.83 (s, 3H), 4.02 (t, 2H), 7.13 (d, 2H), 7.21 (d, 2H), 7.32 (d, 2H), 7.88 (d, 2H), 8.66 (s, 1H), 9.49 (s, 1H); IR measurement results (by a KBr tablet method) 3300, 2920, 2850, 1692, 1665, 1552, 1520, 1451, 1405, 1160 cm$^{-1}$ Synthesis Example 6

Synthesis of N-(p-methoxybenzenesulfonyl)-N'-[4-(n-octadecyloxycarbonylamino)phenyl]urea (Compound No. 10 wherein n=18)

In a three necked flask equipped with a dropping funnel, a thermometer and reflux condenser, p-octadecanol (173 g) was dissolved in toluene (1250 ml) in a nitrogen atmosphere. To the solution, p-nitrophenyl isocyanate (100 g) was gradually added, stirred at room temperature for 10 minutes, and then refluxed for 30 minutes. The reaction mixture was cooled to room temperature to allow crystals to precipitate. The crystals were collected by filtering and washed with toluene, to obtain n-octadecyl p-nitrophenylcarbamate (257 g) at a yield of 97%.

The crystals were dissolved in tetrahydrofuran (5000 ml) and added with a 5% palladium carbon (38 g) and the mixture was vigorously stirred in a hydrogen atmosphere under a pressure of 3 atmospheres for 2 hours. After the reaction was completed, the palladium carbon was removed by filtering, and the solvent was removed under reduced pressure, to produce crystals. The crystals were collected, and recrystallized from ethanol, to obtain n-octadecyl p-aminophenylcarbamate (203 g) at a yield of 85%.

The crystals were suspended in toluene (4000 ml) and added with methyl(p-methoxybenzenesulfonyl)carbamate (129 g) of Synthesis Example 1, while stirring the mixture, and the mixture was heat-refluxed for 5 hours. The reaction liquid was cooled to room temperature to allow white crystals to precipitate. The crystals were collected by filtering under reduced pressure. The crystals were washed with acetonitrile and dried under reduced pressure. The target product (273 g) was obtained at a yield of 88%.

The analysis results of the crystals are as follows.

Melting temperature: 190° C.; $^1$H-NMR measurement results in ppm (in denterated methylsulfoxide); δ=0.85 (t, 3H), 1.22 (br.s, 30H), 1.57–1.60 (m, 2H), 3.83 (s, 3H), 4.02 (t, 2H), 7.13 (d, 2H), 7.21 (d, 2H), 7.32 (d, 2H), 7.88 (d, 2H), 8.66 (s, 1H), 9.49 (s, 1H); IR measurement results (by a KBr tablet method); 3300, 2920, 2850, 1692, 1665, 1552, 1520, 1451, 1405, 1160 cm$^{-1}$ Synthesis Example 7

Synthesis of N-(p-methoxybenzenesulfonyl)-N'-[4-(n-eicocyloxycarbonylamino)phenyl]urea (Compound No. 10 wherein n=20)

In a three necked flask equipped with a dropping funnel, a thermometer and reflux condenser, n-eicosanol (182 g) was dissolved in toluene (1250 ml) in a nitrogen atmosphere. To the solution, p-nitrophenyl isocyanate (100 g) was gradually added, stirred at room temperature for 10 minutes, and then heat-refluxed for 30 minutes. The reaction liquid was cooled to room temperature to allow crystals to precipitate. The crystals were collected by filtering and washed with toluene, to obtain n-eicocyl p-nitrophenylcarbamate (270 g) at a yield of 96%.

The crystals were dissolved in tetrahydrofuran (5400 ml) and added with a 5% palladium carbon (38 g) and the mixture was vigorously stirred in a hydrogen atmosphere under a pressure of 3 atmospheres for 2 hours. After the reaction was completed, the palladium carbon was removed by filtering, and the solvent was removed under reduced pressure, to produce crystals. The crystals were collected, and recrystallized from ethanol, to obtain n-eicocyl p-aminophenylcarbamate (210 g) at a yield of 83%.

The crystals were suspended in toluene (4000 ml) and to the suspension, methyl(p-methoxybenzenesulfonyl) carbamate (129 g) of Synthesis Example 1 was added dropwise over a time span of 10 minutes, while stirring the mixture. After the completion of the dropwise addition, the mixture was heat-refluxed for 5 hours. The reaction mixture was cooled to room temperature to allow white crystals to precipitate. The crystals were collected by filtering under reduced pressure. The crystals were washed with acetonitrile and dried under reduced pressure. The target product (270 g) was obtained at a yield of 86%.

The analysis results of the crystals are as follows.

Melting temperature: 182° C.; $^1$H-NMR measurement results in ppm (in denterated methylsulfoxide) δ=0.85 (t, 3H), 1.22 (br.s, 34H), 1.57–1.60 (m, 2H), 3.83 (s, 3H), 4.02 (t, 2H), 7.13 (d, 2H), 7.21 (d, 2H), 7.32 (d, 2H), 7.88 (d, 2H), 8.66 (s, 1H), 9.49 (s, 1H); IR measurement results (by a KBr tablet method); 3300, 2920, 2850, 1692, 1665, 1552, 1520, 1451, 1405, 1160 cm$^{-1}$ Synthesis Example 8

Synthesis of N-(p-methoxybenzenesulfonyl)-N'-[4-{(n-hexadecylthio)carbonylamino}phenyl]urea (Compound No. 12 wherein n=16)

In a three necked flask equipped with a dropping funnel, a thermometer and reflux condenser, n-hexadecanethiol (165 g) was dissolved in acetonitrile (1000 ml) in a nitrogen atmosphere. To the solution, p-nitrophenyl isocyanate (100 g) was gradually added, stirred at room temperature for 10 minutes, and then heat-refluxed for 30 minutes. The reaction liquid was cooled to room temperature to allow crystals to precipitate. The crystals were collected by filtering and washed with acetonitrile, to obtain S-n-hexadecyl p-nitrophenylthiocarbamate (250 g) at a yield of 97%.

The crystals were dissolved in a mixture of concentrated hydrochloric acid (500 ml) with ethanol (500 ml) and an ethanol solution (500 ml) of tin chloride dihydrate (550 g) was added dropwise to the solution. After the dropwise addition was completed, the mixture was heated at 90° C. for 2 hours. The reaction liquid was cooled to room temperature, the resultant hydrochloric acid salt was collected by filtering and suspended in water (1000 ml), and the suspension was neutralized with triethylamine. The product was collected by suction-filtering, and recrystallized from ethanol, to obtain S-n-hexadecyl p-aminophenylcarbamate (200 g) at a yield of 86%.

The crystals were suspended in toluene (4000 ml) and added with methyl(p-methoxybenzenesulfonyl)carbamate (131 g) of Synthesis Example 1, while stirring the suspension, and the suspension was heat-refluxed for 5 hours. The reaction liquid was cooled to room temperature to allow white crystals to precipitate. The crystals were collected by filtering under reduced pressure. The crystals were washed with acetonitrile and dried under reduced pressure. The target product (284 g) was obtained at a yield of 92%.

The analysis results of the crystals are as follows.

Melting temperature: 197° C.; $^1$H-NMR measurement results in ppm (in denterated methylsulfoxide); δ=0.85 (t, 3H), 1.23 (br.s, 26H), 1.50–1.56 (m, 2H), 2.83 (t, 2H), 3.83 (s, 3H), 7.12 (d, 2H), 7.24 (d, 2H), 7.37 (d, 2H), 7.88 (d, 2H), 8.73 (s, 1H), 10.17 (s, 1H); IR measurement results (by a KBr tablet method); 3300, 2920, 2850, 1692, 1665, 1552, 1520, 1451, 1405, 1160 cm$^{-1}$ Synthesis Example 9

Synthesis of N-(p-methoxybenzenesulfonyl)-N'-[4-{(n-octadecylthio)carbonylamino}phenyl]urea (Compound No. 10 wherein n=18)

In a three necked flask equipped with a dropping funnel, a thermometer and reflux condenser, n-octadecanethiol (183 g) was dissolved in acetonitrile (1000 ml) in a nitrogen atmosphere. To the solution, p-nitrophenyl isocyanate (100 g) was gradually added and then pyridine (4 ml) was added dropwise, the mixture was stirred at room temperature for 10 minutes and then refluxed for 30 minutes. The reaction mixture was cooled to room temperature to allow crystals to precipitate. The crystals were collected by filtering and washed with acetonitrile, to obtain S-n-octadecyl p-nitrophenylthiocarbamate (272 g) at a yield of 99%.

The crystals were suspended in a mixture of concentrated hydrochloric acid (500 ml) with ethanol (500 ml), and to the suspension, an ethanol solution (500 ml) of tin chloride dihydrate (550 g) was added dropwise. After the dropwise addition was completed, the reaction mixture was heated at 90° C. for 2 hours. After the reaction mixture was cooled to room temperature, the resultant salt of hydrochloric acid was collected by filtering, suspended in water (1000 ml) and neutralized with triethylamine. The product was collected by suction-filtering, and recrystallized from ethanol, to obtain S-n-octadecyl p-aminophenylcarbamate (231 g) at a yield of 91%.

The crystals were suspended in toluene (4000 ml), and to the suspension, methyl(p-methoxybenzenesulfonyl) carbamate (141 g) of Synthesis Example 1 was added dropwise over a time span of 10 minutes, while stirring the suspension. After the dropwise addition was completed, the mixture was refluxed for 5 hours. The reaction mixture was cooled to room temperature to allow white crystals to precipitate. The crystals were collected by filtering under reduced pressure. The crystals were washed with acetonitrile and dried under reduced pressure. The target product (317 g) was obtained at a yield of 91%.

The analysis results of the crystals are as follows.

Melting temperature: 195° C.; $^1$H-NMR measurement results in ppm (in denterated methylsulfoxide); δ=0.85 (t, 3H), 1.23 (br.s, 30H), 1.50–1.56 (m, 2H), 2.83 (t, 2H), 3.83 (s, 3H), 7.12 (d, 2H), 7.24 (d, 2H), 7.37 (d, 2H), 7.88 (d, 2H), 8.73 (s, 1H), 10.17 (s, 1H); IR measurement results (by a KBr tablet method); 3300, 2920, 2850, 1692, 1665, 1552, 1520, 1451, 1405, 1160 cm$^{-1}$ Example 1

A thermosensitive reversible recording sheet was prepared by the following procedures.

(1) Preparation of Dispersion A

| Component | Amount (part) |
|---|---|
| 3-dibutylamino-6-methyl-7-anilinofluoran | 20 |
| 10% polyvinyl alcohol solution | 10 |
| Water | 70 |

The above-mentioned composition was pulverized by using a sand grinder to an extent such that the average size of the particles reached a level of 1 μm or less.

(2) Preparation of Dispersion B

| Component | Amount (part) |
|---|---|
| N-(p-methoxybenzenesulfonyl)-N'-[4-(n-octadecanoylamino)phenyl]urea (Compound No. 1, n = 17) | 20 |
| 10% polyvinyl alcohol solution | 10 |
| Water | 70 |

The above-mentioned composition was pulverized by using a sand grinder to an extent such that the average size of the particles reached a level of 1 μm or less.

(3) Preparation of Dispersion C

| Component | Amount (part) |
|---|---|
| Di-p-methylbenzyl oxalate ester | 20 |
| 10% polyvinyl alcohol solution | 10 |
| Water | 70 |

The above-mentioned composition was pulverized to an extent such that the average size of the particles reached a level of 1 μm or less.

(4) Formation of Reversible Thermosensitive Recording Layer

A coating liquid was prepared by mixing 75 parts of the dispersion A, 150 parts of the dispersion B and 75 parts of the dispersion C with 30 parts of calcined clay, 2 parts of a 25% paraffin wax emulsion and 100 parts of a 10% polyvinyl alcohol aqueous solution, and agitating the mixture. The coating liquid was coated on a surface of a polyester film having a thickness of 75 μm and dried, to form a reversible thermosensitive recording layer having a dry weight of 5.0 g/m$^2$.

(5) Super Calender Treatment

The thermosensitive sheet as prepared by the above-mentioned procedures was treated by a super calender to provide a calendered surface having a smoothness of 3000 to 5000 seconds. A thermosensitive reversible recording sheet was obtained.

(6) Color-Developing and -Erasing Test

A specimen of the thermosensitive reversible recording sheet as mentioned above was subjected to a printing procedure using a thermosensitive color-developing tester THPMD made by Okura Denki under a printing voltage of 21.7 V at a printing pulse of 1.0 ms. The color density of the resultant colored images was measured by a Macbeth Reflection Color Density Tester RD-914. The test result is shown in Table 1.

Further, the color-developed specimen was heated in a thermal inclination tester made by Toyo Seiki at a temperature of 100° C. under a pressure of 1 kg/cm$^2$ for a heating time of 1 second. Then, the color density of the color erased images was measured by the Macbeth Reflection Color Density Tester RD-914. The test result is shown in Table 1.

(7) Storage Test

After the color density of the colored images of the color-developed specimen was measured by the above-mentioned test (6), the color-developed specimen was left to stand at a temperature of 40° C. for 14 days. Thereafter, the color density of the colored images was measured by the same manner as above. The storage property of the colored images was evaluated by the colored image retention: [(color density of the colored images after the 14 day storage test)/(color density of the colored images immediately after printing)]×100 (%). The test result is shown in Table 1.

(8) Repeated Color-Developing and Erasing Test

The color-developing and erasing test mentioned in test (6) was repeated 50 times, and then, the color densities of the color-developed images and the color-erased images by using the Macbeth Reflection Color Density Tester RD-914.

The test result is shown in Table 1.

Example 2

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-(n-eicosanoylamino) phenyl]urea (Compound No. 1, n=19). The test results are shown in Table 1.

Example 3

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-(n-docosanoylamino) phenyl]urea (Compound No. 1, n=21). The test results are shown in Table 1.

Example 4

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-(n-hexadecyloxycarbonylamino)phenyl]urea (Compound No. 10, n=16). The test results are shown in Table 1.

Example 5

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-(n-octadecyloxycarbonylamino)phenyl]urea (Compound No. 10, n=18). The test results are shown in Table 1.

Example 6

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-(n-eicosyloxycarbonylamino)phenyl]urea (Compound No. 10, n=20). The test results are shown in Table 1.

Example 7

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-{(n-hexadecylthio) carbonylamino}phenyl]urea (Compound No. 12, n=16). The test results are shown in Table 1.

Example 8

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-methoxybenzenesulfonyl)-N'-[4-{(n-octadecylthio) carbonylamino}phenyl]urea (Compound No. 12, n=18). The test results are shown in Table 1.

In each of Examples 1 to 8, the repeats of the color-development and the color-erasure of the images could be 50 times or more. Accordingly, it was confirmed that the thermosensitive reversible recording material of the present invention can be employed repeatedly.

Comparative Example 1

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by a salt of gallic acid with stearylamine. The test results are shown in Table 1.

Comparative Example 2

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by ascorbic acid. The test results are shown in Table 1.

Comparative Example 3

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by 4'-hydroxy-n-octadecaneanilide. The test results are shown in Table 1.

Comparative Example 4

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-toluenesulfonyl)-N'-[4-(n-octadecanoylamino)phenyl]urea. The test results are shown in Table 1.

Comparative Example 5

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-toluenesulfonyl)-N'-[4-(n-hexadecyloxycarbonylamino)phenyl]urea. The test results are shown in Table 1.

Comparative Example 6

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(p-toluenesulfonyl)-N'-[4-{(n-octadecylthio)carbonylamino}phenyl]urea. The test results are shown in Table 1.

TABLE 1

| | Item | | | | |
|---|---|---|---|---|---|
| Example No. | Color density of color-developed images (First time) | Color density of color-erased images (First time) | Color density retention (%) | Color density of color-developed images (50th time) | Color density of color-erased images (50th time) |
| | | | Example | | |
| 1 | 1.42 | 0.09 | 75 | 1.40 | 0.10 |
| 2 | 1.39 | 0.10 | 72 | 1.37 | 0.11 |
| 3 | 1.37 | 0.11 | 71 | 1.36 | 0.13 |
| 4 | 1.36 | 0.10 | 74 | 1.34 | 0.12 |
| 5 | 1.37 | 0.11 | 72 | 1.35 | 0.12 |
| 6 | 1.36 | 0.10 | 72 | 1.35 | 0.11 |
| 7 | 1.40 | 0.11 | 77 | 1.38 | 0.13 |
| 8 | 1.39 | 0.11 | 75 | 1.37 | 0.12 |
| | | | Comparative Example | | |
| 1 | 0.51 | 0.21 | 54 | — | — |
| 2 | 1.02 | 0.85 | 49 | — | — |
| 3 | 0.90 | 0.22 | 38 | — | — |
| 4 | 1.39 | 0.12 | 75 | 1.37 | 0.17 |
| 5 | 1.37 | 0.11 | 72 | 1.35 | 0.16 |
| 6 | 1.40 | 0.12 | 76 | 1.38 | 0.18 |

The compounds of the Compound No. 1, No. 10 and No. 12 prepared in Synthesis Examples 2 to 9 were fully identified novel compounds. Also, as Table 1 clearly shows, the thermosensitive reversible recording materials of the present invention containing the novel compounds as a color-developing agent exhibit a higher color density of color-developed images and a lower color density of color-erased images than those of conventional dye-type thermosensitive reversible recording materials. Also, after a 50 times repeated color-developing and erasing test, no increase in color density of color-erased images was found, and a very high contrast was confirmed. In Comparative Examples 1 to 3, the color-developing property, the color-erasing property and the colored image retention were unsatisfactory, and in Comparative Examples 4 to 6, when the color-developing and erasing procedures were repeated many times, the color-erasing property decreased and became insufficient.

Example 9

The thermosensitive recording layer treated by the super-calender in each of Examples 1 to 8 was coated with an overcoat layer by the following procedure.

Formation of overcoat layer

A coating liquid was prepared by mixing 40 parts of a polyester acrylate (Aronix® M-8030, made by Toa Gosei K.K.) with 40 parts of a polyester acrylate (Aronix® M-6200, made by Toa Gosei K.K.) and 20 parts of precipitated calcium carbonate (Liton A®, made by Bihoku Funka-kogyo K.K.), and agitating the mixture. The coating liquid was coated on the calender-treated thermosensitive recording layer to form a coating having a dry weight of 2.5 g/m$^2$. The coating liquid layer was cured by irradiating electron beam under an accelerating voltage of 175 kV at an absorption dose of 3 Mrad in an electron beam irradiation chamber having an oxygen concentration of 300 ppm or less, to form an overcoat layer.

The results of the color-developing and erasing test, the storage test and the 50 times repeated color-developing and erasing test were approximately the same as those shown in Table 1. Also, it was confirmed that in the 50 times repeated color-developing and erasing test, no cracking or peeling of the coating layer occurred.

Synthesis Example 10

Synthesis of methyl(2-naphthylsulfonyl)carbamate

In a three necked flask equipped with a dropping funnel, a thermometer and a reflux condenser, tetrahydrofuran (3000 ml) was added with 2-naphthylsulfonamide (290 g) and potassium carbonate (490 g), the mixture was stirred. An exothermic reaction occurred in the reaction system and the 2-naphthylsulfonamide was dissolved to produce a potassium salt thereof.

Next, the reaction mixture was added with methyl chloroformate (395 g), and the mixture was heated for 24 hours while refluxing to effect a reaction. After the completion of the reaction, the temperature of the inside of the reactor was adjusted to 50° C. or less, and the tetrahydrofuran and the remaining methyl chloroformate were removed by distillation, to produce a potassium salt of methyl(2-naphthylsulfonyl)carbamate. The potassium salt was added with water (1000 ml) to dissolve the potassium salt therein, and then with hydrochloric acid (230 g) to adjust the pH to 2. Methyl(2-naphthylsulfonyl)carbamate (342 g) precipitated. The yield thereof was 92%.

Synthesis Example 11

Synthesis of N-(2-naphthylsulfonyl)-N'-[4-(n-octadecanoylamino)phenyl]urea (Compound No. 16, n=17)

In a three necked flask equipped with a dropping funnel, a thermometer and a reflux condenser, p-nitroaniline (138 g) was dissolved in a mixed solution of tetrahydrofuran (200 ml) with pyridine (140 ml) in a nitrogen atmosphere. To the solution, octadecanoyl chloride (333 g) was added through the dropping funnel over a time span of 20 minutes, while stirring the reaction mixture. After the completion of the dropwise addition, the reaction mixture was stirred for 2 hours. The resultant solid product was removed by filtering, and the filtrate was concentrated under reduced pressure, to produce crystals. The crystals were collected and recrystallized from ethanol. 4'-nitro-n-octadecaneanilide (364 g) was obtained at a yield of 90%.

The crystals were dissolved in tetrahydrofuran (8000 ml), added with 5% palladium carbon (95 g), and the mixture was vigorously stirred under a pressure of 3 atmospheres in a hydrogen atmosphere.

After the completion of the reaction, the palladium carbon was removed by filtering, and the solvent was removed under reduced pressure, to produce crystals. The crystals were collected and recrystallized from ethanol, to produce 4'-amino-n-octadecaneanilide (300 g) at a yield of 89%.

The crystals were suspended in toluene (6000 ml), and added with the methyl(2-naphthylsulfonyl)carbamate (223 g) prepared in Synthesis Example 10, while stirring, and the reaction mixture was heat-refluxed for 5 hours. When the reaction liquid was cooled to room temperature, white crystals were precipitated. The crystals were collected by filtering under reduced pressure. The crystals were washed with acetonitrile and dried under reduced pressure. The target compound (414 g) was obtained at a yield of 85%.

The analysis results of the crystals were as follows.

Melting temperature: 192° C.; $^1$H-NMR measurement results in ppm (in denterated methylsulfoxide); δ=0.84 (t, 3H), 1.22 (br.s, 28H), 1.53–1.75 (m, 2H), 2.22 (t, 2H), 7.22 (d, 2H), 7.43 (d, 2H), 7.67–7.75 (overlapped dd, 1H×2), 7.96 (d, 1H), 8.05 (d, 1H), 8.15 (d, 1H), 8.22 (d, 1H), 8.61 (s, 1H), 8.79 (s, 1H), 9.75 (s, 1H); IR measurement results (KBr tablet method); 3300, 2920, 2850, 1692, 1665, 1552, 1520, 1451, 1405, 1160 cm$^{-1}$.

Synthesis Example 12

Synthesis of N-(2-naphthylsulfonyl)-N'-[4-(n-eicosanoylamino)phenyl]urea (Compound No. 16, n=19)

In a three necked flask equipped with a dropping funnel, a thermometer and a reflux condenser, p-nitroaniline (138 g) was dissolved in a mixed solution of tetrahydrofuran (200 ml) with pyridine (140 ml) in a nitrogen atmosphere. To the solution, eicosayl chloride (364 g) was added through the dropping funnel over a time span of 20 minutes, while stirring the reaction mixture. After the completion of the dropwise addition, the reaction mixture was stirred for 2 hours. The resultant solid product was removed by filtering, and the filtrate was concentrated under reduced pressure, to produce crystals. The crystals were collected and recrystallized from ethanol. 4'-nitro-n-eicosaneanilide (355 g) was obtained at a yield of 82%.

The crystals were dissolved in tetrahydrofuran (10000 ml), added with 5% palladium carbon (87 g), and the mixture was vigorously stirred under a pressure of 3 atmospheres in a hydrogen atmosphere.

After the completion of the reaction, the palladium carbon was removed by filtering, and the solvent was removed under reduced pressure, to produce crystals. The crystals were collected and recrystallized from ethanol, to produce 4'-amino-n-eicosaneanilide (265 g) at a yield of 80%. The crystals were suspended in toluene (5000 ml), and added with the methyl(2-naphthylsulfonyl)carbamate (183 g) prepared in Synthesis Example 10, while stirring, and the reaction mixture was heat-refluxed for 5 hours. When the reaction liquid was cooled to room temperature, white crystals were precipitated. The crystals were collected by filtering under reduced pressure. The crystals were washed with acetonitrile and dried under reduced pressure. The target compound (364 g) was obtained at a yield of 87%.

The analysis results of the crystals were as follows.

Melting temperature: 179° C.; $^1$H-NMR measurement results in ppm (in denterated methylsulfoxide); δ=0.84 (t, 3H), 1.22 (br.s, 32H), 1.53–1.75 (m, 2H), 2.22 (t, 2H), 7.22 (d, 2H), 7.43 (d, 2H), 7.67–7.75 (overlapped dd, 1H×2), 7.96 (d, 1H), 8.05 (d, 1H), 8.15 (d, 1H), 8.22 (d, 1H), 8.61 (s, 1H), 8.79 (s, 1H), 9.75 (s, 1H); IR measurement results (KBr tablet method); 3300, 2920, 2855, 1690, 1660, 1560, 1520, 1450, 1406, 1160 cm$^{-1}$.

Synthesis Example 13

Synthesis of N-(2-naphthylsulfonyl)-N'-[4-(n-docosanoylamino)phenyl]urea (Compound No. 16, n=21)

In a three necked flask equipped with a dropping funnel, a thermometer and a reflux condenser, p-nitroaniline (138 g) was dissolved in a mixed solution of tetrahydrofuran (200 ml) with pyridine (140 ml) in a nitrogen atmosphere. To the solution, docosayl chloride (395 g) was added through the dropping funnel over a time span of 20 minutes, while stirring the reaction mixture. After the completion of the dropwise addition, the reaction mixture was stirred for 2 hours. The resultant solid product was removed by filtering, and the filtrate was concentrated under reduced pressure, to produce crystals. The crystals were collected and recrystallized from ethanol. 4'-nitro-n-docosaneanilide (405 g) was obtained at a yield of 88%.

The crystals were dissolved in tetrahydrofuran (12000 ml), added with 5% palladium carbon (92 g), and the mixture was vigorously stirred under a pressure of 3 atmospheres in a hydrogen atmosphere.

After the completion of the reaction, the palladium carbon was removed by filtering, and the solvent was removed under reduced pressure, to produce crystals. The crystals were collected and recrystallized from ethanol, to produce 4'-amino-n-docosaneanilide (322 g) at a yield of 80%. The crystals were suspended in toluene (6000 ml), and added with the methyl(2-naphthylsulfonyl)carbamate (208 g) prepared in Synthesis Example 10, while stirring, and the reaction mixture was refluxed for 5 hours. When the reaction liquid was cooled to room temperature, white crystals were precipitated. The crystals were collected by filtering under reduced pressure. The crystals were washed with acetonitrile and dried under reduced pressure. The target compound (446 g) was obtained at a yield of 90%.

The analysis results of the crystals were as follows.

Melting temperature: 179° C.; $^1$H-NMR measurement results in ppm (in denterated methylsulfoxide); δ=0.84 (t, 3H), 1.22 (br.s, 36H), 1.53–1.75 (m, 2H), 2.22 (t, 2H), 7.19 (d, 2H), 7.43 (d, 2H), 7.65–7.74 (overlapped dd, 1H×2), 7.95 (d, 1H), 8.05 (d, 1H), 8.14 (d, 1H), 8.22 (d, 1H), 8.61 (s, 1H), 8.79 (s, 1H), 9.73 (s, 1H); IR measurement results (KBr tablet method); 3300, 2920, 2855, 1690, 1660, 1560, 1520, 1450, 1406, 1160 cm$^{-1}$.

Synthesis Example 14

Synthesis of N-(2-naphthylsulfonyl)-N'-[4-(n-hexadecyloxycarbonylamino)phenyl]urea (Compound No. 17, n=16)

In a three necked flask equipped with a dropping funnel, a thermometer and a reflux condenser, p-hexadecanol (155 g) was dissolved in toluene (1250 ml) in a nitrogen atmosphere. To the solution, p-nitrophenyl isocyanate (100 g) was gradually added, and the mixture was stirred at room temperature for 10 minutes, and refluxed for 30 minutes. When the reaction liquid was cooled to room temperature, crystals were precipitated. The crystals were collected by filtering, washed with toluene, and n-hexadecyl p-nitrophenylcarbamate (240 g) was obtained at a yield of 97%.

The crystals were dissolved in tetrahydrofuran (4800 ml), added with 5% palladium carbon (63 g), and the mixture was vigorously stirred under a pressure of 3 atmospheres in a hydrogen atmosphere for 2 hours.

After the completion of the reaction, the palladium carbon was removed by filtering, and the solvent was removed under reduced pressure, to produce crystals. The crystals were collected and recrystallized from ethanol, to produce n-hexadecyl p-aminophenylcarbamate (189 g) at a yield of 85%.

The crystals were suspended in toluene (4000 ml), and added with the methyl(2-naphthylsulfonyl)carbamate (223 g) prepared in Synthesis Example 10, while stirring, and the reaction mixture was heat-refluxed for 5 hours. When the reaction liquid was cooled to room temperature, white crystals precipitated. The crystals were collected by filtering under reduced pressure. The crystals were washed with acetonitrile and dried under reduced pressure. The target compound (272 g) was obtained at a yield of 89%.

The analysis results of the crystals were as follows.

Melting temperature: 183° C.; $^1$H-NMR measurement results in ppm (in denterated methylsulfoxide); δ=0.84 (t, 3H), 1.22 (br.s, 26H), 1.54–1.59 (m, 2H), 4.01 (t, 2H), 7.19 (d, 2H), 7.30 (d, 2H), 7.67–7.75 (overlapped dd, 1H×2), 7.96 (d, 1H), 8.06 (d, 1H), 8.15 (d, 1H), 8.22 (d, 1H), 8.61 (s, 1H), 8.77 (s, 1H), 9.47 (s, 1H); IR measurement results (KBr tablet method); 3300, 2920, 2850, 1695, 1552, 1525, 1451, 1410, 1162 cm$^{-1}$.

Synthesis Example 15

Synthesis of N-(2-naphthylsulfonyl)-N'-[4-(n-octadecyloxycarbonylamino)phenyl]urea (Compound No. 17, n=18)

In a three necked flask equipped with a dropping funnel, a thermometer and a reflux condenser, p-octadecanol (173 g) was dissolved in toluene (1250 ml) in a nitrogen atmosphere. To the solution, p-nitrophenyl isocyanate (100 g) was gradually added, and the mixture was stirred at room temperature for 10 minutes and then refluxed for 30 minutes. When the reaction mixture was cooled to room temperature, crystals precipitated. The crystals were collected by filtering and washed with toluene. n-octadecyl p-nitrophenylcarbamate (257 g) was obtained at a yield of 97%.

The crystals were dissolved in tetrahydrofuran (5000 ml), added with 5% palladium carbon (63g), and the mixture was vigorously stirred under a pressure of 3 atmospheres in a hydrogen atmosphere for 2 hours.

After the completion of the reaction, the palladium carbon was removed by filtering, and the solvent was removed under reduced pressure, to produce crystals. The crystals were collected and recrystallized from ethanol, to produce n-octadecyl p-aminophenylcarbamate (203 g) at a yield of 85%.

The crystals were suspended in toluene (4000 ml), and added with the methyl(2-naphthylsulfonyl)carbamate (140 g) prepared in Synthesis Example 10, while stirring, and the reaction mixture was heat-refluxed for 5 hours. When the reaction liquid was cooled to room temperature, white crystals were precipitated. The crystals were collected by filtering under reduced pressure. The crystals were washed with acetonitrile and dried under reduced pressure. The target compound (288 g) was obtained at a yield of 90%.

The analysis results of the crystals were as follows.

Melting temperature: 178° C.; $^1$H-NMR measurement results in ppm (in denterated methylsulfoxide); δ=0.84 (t, 3H), 1.22 (br.s, 30H), 1.53–1.58 (m, 2H), 4.02 (t, 2H), 7.19 (d, 2H), 7.30 (d, 2H), 7.67–7.75 (overlapped dd, 1H×2), 7.94 (d, 1H), 8.05 (d, 1H), 8.15 (d, 1H), 8.21 (d, 1H), 8.61 (s, 1H), 8.76 (s, 1H), 9.46 (s, 1H); IR measurement results (KBr tablet method); 3300, 2920, 2850, 1695, 1552, 1525, 1451, 1410, 1162 cm$^{-1}$.

Synthesis Example 16

Synthesis of N-(2-naphthylsulfonyl)-N'-[4-(n-eicosyloxycarbonylamino)phenyl]urea (Compound No. 17, n=20)

In a three necked flask equipped with a dropping funnel, a thermometer and a reflux condenser, n-eicosanol (182 g) was dissolved in toluene (1250 ml) in a nitrogen atmosphere. To the solution, p-nitrophenyl isocyanate (100 g) was gradually added, and the mixture was stirred at room temperature for 10 minutes and then heat-refluxed for 30 minutes. When the reaction liquid was cooled to room temperature, crystals precipitated. The crystals were collected by filtering and washed with toluene. n-eicosyl p-nitrophenylcarbamate (270 g) was obtained at a yield of 96%.

The crystals were dissolved in tetrahydrofuran (5400 ml), added with 5% palladium carbon (62 g), and the mixture was vigorously stirred under a pressure of 3 atmospheres in a hydrogen atmosphere for 2 hours.

After the completion of the reaction, the palladium carbon was removed by filtering, and the solvent was removed under reduced pressure, to produce crystals. The crystals were collected and recrystallized from ethanol, to produce n-eicosyl p-aminophenylcarbamate (210 g) at a yield of 83%.

The crystals were suspended in toluene (4000 ml), and added with the methyl(2-naphthylsulfonyl)carbamate (135 g) prepared in Synthesis Example 10, while stirring, and the reaction mixture was heat-refluxed for 5 hours. When the reaction liquid was cooled to room temperature, white crystals were precipitated. The crystals were collected by filtering under reduced pressure. The crystals were washed with acetonitrile and dried under reduced pressure. The target compound (284 g) was obtained at a yield of 88%.

The analysis results of the crystals were as follows.

Melting temperature: 181° C.; $^1$H-NMR measurement results in ppm (in denterated methylsulfoxide); δ=0.84 (t, 3H), 1.21 (br.s, 34H), 1.55–1.58 (m, 2H), 4.01 (t, 2H), 7.19 (d, 2H), 7.30 (d, 2H), 7.67–7.75 (overlapped dd, 1H×2), 7.96 (d, 1H), 8.05 (d, 1H), 8.15 (d, 1H), 8.21 (d, 1H), 8.61 (s, 1H), 8.76 (s, 1H), 9.46 (s, 1H); IR measurement results (KBr tablet method); 3300, 2920, 2850, 1692, 1695, 1552, 1525, 1451, 1410, 1162 cm$^{-1}$.

Synthesis Example 17

Synthesis of N-(2-naphthylsulfonyl)-N'-[4-{(n-hexadecylthio)carbonylamino}phenyl]urea (Compound No. 24, n=17)

In a three necked flask equipped with a dropping funnel, a thermometer and a reflux condenser, n-hexadecanethiol (165 g) was dissolved in acetonitrile (1000 ml). To the solution, p-nitrophenyl isocyanate (100 g) was gradually added, then pyridine (4 ml) was added dropwise, and the mixture was stirred at room temperature for 10 minutes, and then heat-refluxed for 30 minutes. When the reaction mixture was cooled to room temperature, crystals precipitated. The crystals were collected by filtering and washed with acetonitrile. S-n-hexadecyl p-nitrophenylthiocarbamate (250 g) was obtained at a yield of 97%.

The crystals were dissolved in a mixture of concentrated hydrochloric acid (500 ml) and ethanol (500 ml) and added dropwise with an ethanol solution (500 ml) of tin chloride dihydrate (550 g). After the completion of the dropwise addition, the mixture was stirred and heated at 90° C. for 2 hours. After the reaction liquid was cooled to room temperature, the resultant chloride salt was collected by filtering and suspended in water (1000 ml), and the suspension was neutralized with triethylamine. The resultant product was collected by suction-filtering and recrystallized from ethanol. S-n-hexadecyl p-aminophenyl carbamate (200 g) was obtained at a yield of 86%. The product was suspended in toluene (4000 ml), and added with the methyl(2-naphthylsulfonyl)carbamate (142 g) prepared in Synthesis Example 10, while stirring, and the reaction mixture was refluxed for 5 hours. When the reaction mixture was cooled to room temperature, white crystals precipitated. The crystals were collected by filtering under reduced pressure. The crystals were washed with acetonitrile and dried under reduced pressure. The target compound (287 g) was obtained at a yield of 90%.

The analysis results of the crystals were as follows.

Melting temperature: 190° C.; $^1$H-NMR measurement results in ppm (in denterated methylsulfoxide); δ=0.84 (t, 3H), 1.25 (br.s, 26H), 1.49–1.54 (m, 2H), 2.82 (t, 2H), 7.22 (d, 2H), 7.35 (d, 2H), 7.67–7.75 (overlapped dd, 1H×2), 7.96 (d, 1H), 8.05 (d, 1H), 8.15 (d, 1H), 8.22 (d, 1H), 8.62 (s, 1H), 8.87 (s, 1H), 10.15 (s, 1H); IR measurement results (KBr tablet method); 3300, 2920, 2850, 1692, 1650, 1552, 1520, 1451, 1405, 1160 cm$^{-1}$.

Synthesis Example 18

Synthesis of N-(2-naphthylsulfonyl)-N'-[4-{(n-octadecylthio)carbonylamino}phenyl]urea (Compound No. 24, n=18)

In a three necked flask equipped with a dropping funnel, a thermometer and a reflux condenser, n-octadecanethiol (183 g) was dissolved in acetonitrile (1000 ml) in a nitrogen atmosphere. To the solution, p-nitrophenyl isocyanate (100 g) was gradually added, and then pyridine (4 ml) was added dropwise, the mixture was stirred at room temperature for 10 minutes and then heat-refluxed for 30 minutes. When the reaction mixture was cooled to room temperature, crystals precipitated. The crystals were collected by filtering and washed with acetonitrile. S-n-octadecyl p-nitrophenylthiocarbamate (272 g) was obtained at a yield of 99%.

The crystals were suspended in a mixture of concentrated hydrochloric acid (500 ml) with ethanol (500 ml), and then an ethanol solution (500 ml) of tin chloride dihydrate (550 g) was added dropwise to the suspension. After the dropwise addition was completed, the mixture was stirred and heated at 90° C. for 2 hours. After the reaction mixture was cooled to room temperature, the resultant chloride salt was collected by filtering and suspended in water (1000 ml) and then the suspension was neutralized with triethylamine. The product was collected by suction-filtering and recrystallized from ethanol. S-n-octadecyl p-aminophenylcarbamate (231g) was obtained at a yield of 91%.

The product was suspended in toluene (4000 ml), and added with the methyl(2-naphthylsulfonyl)carbamate (153 g) prepared in Synthesis Example 10, while stirring, and the reaction mixture was refluxed for 5 hours. When the reaction mixture was cooled to room temperature, white crystals were precipitated. The crystals were collected by filtering under reduced pressure. The crystals were washed with acetonitrile and dried under reduced pressure. The target compound (320 g) was obtained at a yield of 89%.

The analysis results of the crystals were as follows.

Melting temperature: 193° C.; $^1$H-NMR measurement results in ppm (in denterated methylsulfoxide); δ=0.84 (t, 3H), 1.21 (br.s, 30H), 1.49–1.54 (m, 2H), 2.83 (t, 2H), 7.22 (d, 2H), 7.35 (d, 2H), 7.67–7.75 (overlapped dd, 1H×2), 7.96 (d, 1H), 8.05 (d, 1H), 8.15 (d, 1H), 8.22 (d, 1H), 8.61 (s, 1H), 8.88 (s, 1H), 10.15 (s, 1H); IR measurement results (KBr tablet method); 3300, 2920, 2850, 1692, 1650, 1552, 1520, 1451, 1405, 1160 cm$^{-1}$.

Example 10

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea was replaced by N-(2-naphthylsulfonyl)-N'-[4-(n-octadecanoylamino)phenyl]urea (Compound No. 16, n=17).

The test results are shown in Table 2.

Example 11

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-(n-eicosanoylamino)phenyl]urea (Compound No. 16, n=19).

The test results are shown in Table 2.

Example 12

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-(n-docosanoylamino)phenyl]urea (Compound No. 16, n=21).

The test results are shown in Table 2.

Example 13

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-(n-hexadecyloxycarbonylamino)phenyl]urea (Compound No. 17, n=16).

The test results are shown in Table 2.

Example 14

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-(n-octadecyloxycarbonylamino)phenyl]urea (Compound No. 17, n=18).

The test results are shown in Table 2.

Example 15

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-(n-eicosyloxycarbonylamino)phenyl]urea (Compound No. 17, n=20).

The test results are shown in Table 2.

Example 16

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-{(n-hexadecylthio)carbonylamino}phenyl]urea (Compound No. 24, n=16).

The test results are shown in Table 2.

Example 17

A thermosensitive reversible recording sheet was prepared and tested by the same procedures as in Example 10 with the following exceptions.

In the preparation of the dispersion B, the N-(2-naphthylsulfonyl)-N'-[4-(n-octadecanoylamino)phenyl]urea was replaced by N-(2-naphthylsulfonyl)-N'-[4-{(n-octadecylthio)carbonylamino}phenyl]urea (Compound No. 24, n=18).

The test results are shown in Table 2.

In each of Examples 10 to 17, the repeats of the color-development and the color-erasion of the images were smoothly carried out many times. Accordingly, it was confirmed that the thermosensitive reversible recording material containing the color-developing compound of the present invention can be employed repeatedly.

TABLE 2

| Example No. | Color density of color-developed images (First time) | Color density of color-erased images (First time) | Color retention (%) | Color density of color-developed images (50-th time) | Color density of color-erased images (50-th time) |
|---|---|---|---|---|---|
| | Item | | | | |
| | Example | | | | |
| 10 | 1.43 | 0.11 | 94 | 1.41 | 0.12 |
| 11 | 1.41 | 0.10 | 92 | 1.39 | 0.11 |
| 12 | 1.40 | 0.10 | 91 | 1.39 | 0.11 |
| 13 | 1.39 | 0.11 | 90 | 1.38 | 0.12 |
| 14 | 1.39 | 0.10 | 87 | 1.37 | 0.11 |
| 15 | 1.37 | 0.09 | 86 | 1.36 | 0.10 |
| 16 | 1.43 | 0.12 | 94 | 1.40 | 0.13 |
| 17 | 1.41 | 0.11 | 92 | 1.39 | 0.12 |

The compounds of Compound No. 16, No. 17 and No. 28, prepared in Synthesis Examples 11 to 18 were fully identified novel compounds. Also, as Table 2 clearly shows, when the compounds of the present invention are used as a color developing agent for the thermosensitive reversible recording material, it was confirmed that the resultant color density of color-developed images was higher and the resultant color density of color-erased images was lower than those of the conventional dye type thermosensitive reversible recording materials, no increase in color density of the color-erased images after the 50 time repeated color-developing and erasing test was formed, and a high contrast was obtained.

Example 18

To the super calender-treated thermosensitive recording layer in each of Examples 10 to 17, an overcoat layer-forming procedure was applied as explained below.

(7) Formation of overcoat layer

On the thermosensitive recording layer, an ultraviolet ray-curable urethane acrylate resin (Unidic®17-824-9, made by Dainiphon Insatsukagaku K.K.) was coated in a dry amount of 2 g/m$^2$ by using an offset printer, and then ultraviolet rays were irradiated from an ultraviolet ray-curing apparatus having one 1.2 kW mercury lamp to the coating layer at a distance of 10 cm from the lamp, at a transportation velocity of 15 m/minute, to form an overcoat layer.

The results of the color-developing and erasing test, the storage test, and repeated color-developing and erasing test applied to the resultant thermosensitive reversible recording sheets were approximately identical to those shown in Table 2. Also, it was confirmed that the 50 time-repeated color-developing and erasing procedures did not cause the coating layer to be cracked or peeled.

Example 19

A thermosensitive reversible recording material was produced by the following procedures.

(1) Preparation of Dispersion A

| Component | Amount (part) |
|---|---|
| 3-dibutylamino-6-methyl-7-anilinofluoran | 20 |

-continued

| Component | Amount (part) |
|---|---|
| 10% polyvinyl alcohol solution | 10 |
| Water | 70 |

The above-mentioned composition was pulverized by using a sand grinder to an extent such that the average size of the particles reached a level of 1 μm or less.

(2) Preparation of Dispersion B

| Component | Amount (part) |
|---|---|
| N-(2-naphthylsulfonyl)-N'-[4-(n-octadecanoylamino)phenyl]urea (Compound No. 16, wherein n = 17) | 20 |
| 10% polyvinyl alcohol solution | 10 |
| Water | 70 |

The above-mentioned composition was pulverized to an extent such that the average size of the particles reached to a level of 1 μm or less.

(3) Preparation of Dispersion C

| Component | Amount (part) |
|---|---|
| Di-p-methylbenzyl oxalate ester | 20 |
| 10% polyvinyl alcohol solution | 10 |
| Water | 70 |

The above-mentioned composition was pulverized to an extent such that the average size of the particles reached a level of 1 μm or less.

(4) Formation of Reversible Thermosensitive Recording Layer

A coating liquid was prepared by mixing 75 parts of the dispersion A, 150 parts of the dispersion B and 75 parts of the dispersion C with 30 parts of calcined day (Ansilex 93, made by Engelhart Co.), 2 parts of a 25% paraffin wax emulsion and 100 parts of an aqueous solution of 10% of polyvinyl alcohol (NM-11Q, made by Nihon Gosei K.K.), and agitating the mixture, the coating liquid was coated and dried in a dry coating amount of 5.0 g/m$^2$ on a polyester film having a thickness of 75 μm (Lumilar E, made by Toray), to form a reversible thermosensitive recording layer.

(5) Formation of intermediate barrier layer

A coating liquid for an intermediate barrier layer was prepared by mixing 5 parts of a kaolinite clay dispersion (solid content: 60%, made by Hueber Co., HG Clay), with 200 parts of an aqueous carboxy-modified polyvinyl alcohol solution (solid content: 10%, made by Kuraray K.K., KL-318) and agitating the mixture. The coating liquid was coated on the thermosensitive recording layer mentioned in section (4), and dried to form an intermediate layer having a dry weight of 1.5 g/m$^2$.

(6) Super calender treatment

The intermediate barrier layer mentioned in section (5) was treated by a super calender to adjust the Bekk smoothness of the surface to the level of 3000 to 5000 seconds.

(7) Formation of overcoat layer

A coating liquid for an overcoat layer was prepared by mixing 40 parts of a polyester acrylate (Aronix® M-8030, made by Toa Gosei K.K.), with 40 parts of a polyester acrylate (Aronix® M-6200, made by Toa Gosei K.K.) and 20 parts of precipitated calcium carbonate (Liton A®, made by Bikoku Funkakogyo K.K.) and agitating the mixture. The coating liquid was coated on the calender-treated intermediate barrier layer mentioned in section (6) to form a coating layer in an amount of 2.5 g/m$^2$. To the resultant coating layer, an electron beam was irradiated in an electron beam-irradiation chamber having an oxygen concentration of 300 ppm or less, under an acceleration voltage of 175 kV at an absorption dose of 3 Mrad, to form an overcoat layer. A thermosensitive reversible recording material was obtained.

(8) Test

The resultant thermosensitive reversible recording material was subjected to the same tests as in Example 1. In the repeated durability test, after 50 repeated color-developing and erasing procedures, the conditions of the thermosensitive recording layer were evaluated by naked eye observation. The results of the tests are shown in Table 3. In Table 3, after 50 repeated color-developing and erasing procedures where no cracking or peeling occurred in the thermosensitive recording layer, this result was indicated by ">50", and where cracking or peeling occurred, the result was indicated by "<50".

Example 20

A thermosensitive reversible recording sheet was prepared and tested by the same procedures as in Example 19 with the following exceptions.

In the formation of the overcoat layer, the polyester acrylate (Aronix® M-8030, made by Toa Gosei K.K.) was replaced by a urethane acrylate (trademark: BS 551, made by Arakawa Kagaku K.K.), and the polyester acrylate (Aronix® M-6200, made by Toa Gosei K.K.) was replaced by a tripropyleneglycol diacrylate (Kayad® TPGDA, made by Nihon Kagaku K.K.).

The test results are shown in Table 3.

Example 21

A thermosensitive reversible recording sheet was prepared and tested by the same procedures as in Example 20 with the following exceptions.

In the formation of the overcoat layer, the polyester acrylate (Aronix® M-8030, made by Toa Gosei K.K.) was replaced by urethane acrylate (trademark: EB 292, made by Daiya UCB), and the polyester acrylate (Aronix® M-6200, made by Toa Gosei K.K.) was replaced by a dipentaerythritol pentaacrylate (Kayarad® D-210, made by Nihon Kagaku K.K.).

The test results are shown in Table 3.

Example 22

A thermosensitive reversible recording material was produced and tested by the same procedures as in Example 19 except that the overcoat layer was formed by the following procedures.

The thermosensitive recording layer was coated with an ultraviolet ray-curable urethane acrylate resin (Unidic® 17-824-9, made by Dainihon Insatsukagaku K.K.) by an offset printer, to form a coating layer in a dry amount of 2 g/m$^4$. Onto the coating layer, ultraviolet rays were irradiated by using an ultraviolet-ray curing apparatus having one 1.2 kW mercury lamp at a distance of 10 cm from the lamp and at a transportation velocity of 15 m/minute, to form an overcoat layer.

The test results are shown in Table 3.

Example 23

A thermosensitive reversible recording material was produced and tested by the same procedures as in Example 22, except that in the formation of the overcoat layer, the ultraviolet ray-curable urethane acrylate resin (Unidic® 17-824-9, made by Dainihon Insatsukagaku K.K.) was replaced by an ultraviolet ray-curable epoxy acrylate resin (Unidic® 7-127, made by Dainihon Insatsukagaku K.K.).

The test results are shown in Table 3.

Example 24

A thermosensitive reversible recording material was produced by the same procedures as in Example 19, except that in the preparation of the dispersion B, the N-(2-naphthylsulfonyl)-N'-[4-(n-octadecanoylamino)phenyl]urea (Compound No. 16 wherein n=17) was replaced by N-(p-methoxybenzenesulfonyl)-N'-[4-(n-octadecanoylamino) phenyl]urea (Compound No. 1 wherein n=17).

The test results are shown in Table 3.

Example 25

A thermosensitive reversible recording material was produced and tested by the same procedures as in Example 19, except that the overcoat layer was formed by the following procedures.

A coating liquid for the overcoat layer was prepared by mixing 70 parts of ground calcium carbonate (trademark: NS-1000, made by Nitto Funkakogyo K.K.) with 100 parts of an urethane acrylate emulsion (solid content: 40%, trademark: FM 90, made by Arakawa Kagaku K.K.) and 40 parts of water, and agitating the mixture. The coating liquid was coated on the intermediate barrier layer mentioned in Example 19, section (5), and dried, to form a dry coating layer having a dry weight of 2.5 g/m$^2$. To the resultant coating layer, the electron beam irradiation was applied under the same conditions as in Example 19, section (7), to form an overcoat layer.

The test results are shown in Table 3.

Example 26

A thermosensitive reversible recording material was produced and tested by the same procedures as in Example 20 except that in the preparation of the dispersion A, the 3-dibutylamino-6-methyl-7-anilinofluoran was replaced 3-(4-diethylamino-2-ethoxyphenyl)-3-(1-ethyl-2-methylindole-3-yl)-4-azaphthalide.

The test results are shown in Table 3.

Comparative Example 7

A thermosensitive reversible recording material was produced and tested by the same procedures as in Example 19 except that in the preparation of the dispersion B, the N-(2-naphthylsulfonyl)-N'-[4-(n-octadecanoylamino)

phenyl]urea (Compound No. 1 wherein n=17) was replaced by N-(4-hydroxyphenyl)-N'-n-octadecylurea.

The test results are shown in Table 3.

Comparative Example 8

A thermosensitive reversible recording material was produced and tested by the same procedures as in Example 19 except that the intermediate barrier layer was omitted, and the formation of the overcoat layer was carried out in the following manner.

A coating liquid for the overcoat layer was prepared by mixing 250 parts of an aqueous polyvinyl alcohol solution (solid content: 10%, made by Nihon Gosei K.K., GL-05) with 50 parts of a clay dispersion (solid content: 50%, made by Engelhart Co., HT clay), and agitating the mixture. The coating liquid was coated on the same thermosensitive recording layer as that mentioned in Example 19, section (4), and dried to form an overcoat layer having a dry weight of 4 g/m$^2$.

Also, in the preparation of the dispersion B, the N-(2-naphthylsulfonyl)-N'-[4-(n-octadecanoylamino)phenyl]urea (Compound No. 16 wherein n=17) was replaced by N-(p-toluenesulfonyl)-N'-[4(n-octadecanoylamino)phenyl]urea.

The test results are shown in Table 3.

TABLE 3

| Example No. | Color density of color-developed images (First time) | Color density of color-erased images (First time) | Color rentention (%) | Color density of color-developed images (50-th time) | Color density of color-erased images (50-th time) | Repeat durability |
|---|---|---|---|---|---|---|
| | Item | | | | | |
| | | | Example | | | |
| 19 | 1.42 | 0.11 | 93 | 1.40 | 0.12 | >50 |
| 20 | 1.41 | 0.12 | 94 | 1.39 | 0.13 | >50 |
| 21 | 1.43 | 0.12 | 92 | 1.41 | 0.12 | >50 |
| 22 | 1.41 | 0.11 | 93 | 1.39 | 0.12 | >50 |
| 23 | 1.42 | 0.12 | 92 | 1.40 | 0.14 | >50 |
| 24 | 1.40 | 0.10 | 75 | 1.38 | 0.12 | >50 |
| 25 | 1.41 | 0.12 | 91 | 1.40 | 0.13 | >50 |
| 26 | 1.31 | 0.09 | 83 | — | — | >50 |
| | | | Comparative Example | | | |
| 7 | 1.36 | 0.20 | 51 | 1.25 | 0.28 | >50 |
| 8 | 1.38 | 0.12 | 74 | 1.37 | 0.18 | <50 |

From Table 3, it is clear from the comparison of Examples 19 to 26 to Comparative Examples 7 and 8 that in the thermosensitive reversible recording materials of the present invention, the resultant colored images have a high color retention and the color density of the color-erased images after the repeated test does not increase, compared with those of the conventional thermosensitive reversible recording materials.

Also, the repeat durability of the thermosensitive recording layer can be enhanced by forming thereon an overcoat layer comprising the electron-beam or ultraviolet-ray cured polymer.

Example 27

A thermosensitive reversible recording material was produced by the following procedures.

(1) Preparation of Dispersion A

| Component | Amount (part) |
|---|---|
| 3-dibutylamino-6-methyl-7-anilinofluoran | 20 |
| 10% polyvinyl alcohol solution | 10 |
| Water | 70 |

The above-mentioned composition was pulverized by using a sand grinder to an extent such that the average size of the particles reached a level of 1 μm or less.

(2) Preparation of Dispersion B

| Component | Amount (part) |
|---|---|
| N-(p-methoxybenzenesulfonyl)-N'-[4-(n-octadecanoylamino)phenyl]urea (Compound No. 1, wherein n = 17) | 20 |
| 10% polyvinyl alcohol solution | 10 |
| Water | 70 |

The above-mentioned composition was pulverized to an extent such that the average size of the particles reached to a level of 1 μm or less.

(3) Preparation of Dispersion C

| Component | Amount (part) |
|---|---|
| Di-p-methylbenzyl oxalate ester | 20 |
| 10% polyvinyl alcohol solution | 10 |
| Water | 70 |

The above-mentioned composition was pulverized to an extent such that the average size of the particles reached a level of 1 μm or less.

(4) Formation of Reversible Thermosensitive Recording Layer

A coating liquid was prepared by mixing 75 parts of the dispersion A, 140 parts of the dispersion B and 140 parts of the dispersion C with 8 parts of calcined day, 2 parts of a 25% paraffin wax emulsion and 170 parts of an aqueous solution of 10% of polyvinyl alcohol, and agitating the mixture. The coating liquid was coated in a dry coating amount of 5.0 g/m$^2$ on a polyester film having a thickness of 75 $\mu$m, and dried to form a reversible thermosensitive recording layer.

(5) Formation of Overcoat Layer

A coating liquid for an overcoat layer was prepared by mixing 50 parts of a kaolinite clay dispersion (solid content: 60%) with 350 parts of an 1% aqueous modified polyvinyl alcohol solution, 220 parts of a 1% aqueous casein solution, 2 parts of a 25% paraffin wax emulsion, 10 parts of a dimethylol urea cross-linking agent and 35 parts of water, and agitating the mixture. The coating liquid was coated on the reversible thermosensitive recording layer and dried to form an overcoat layer in a dry amount of 1.5 g/m$^2$.

(6) Super Calender Treatment

The thermosensitive recording sheet produced as mentioned above was subjected to a smoothing treatment by a super calender, and the Bekk smoothness of the surface of the thermosensitive recording layer was adjusted to 3000 to 5000 seconds. A thermosensitive reversible recording material was obtained.

The above-mentioned thermosensitive reversible recording material was subjected to the same tests as in Example 1, except that in the repeated color-developing and erasing test, the color-developing and erasing procedures were repeated 30 times. The test results are shown in Table 4.

Example 28

A thermosensitive reversible recording material was produced and tested by the same procedures as in Example 27 except that in the preparation of the dispersion B, the N-(p-methoxybenzenesulfoyl)-N'-[4-(n-octadecanoylamino)phenyl]urea (Compound No. 1 wherein n=17) was replaced by N-(p-methoxybenzenesulfonyl)-N'[4-(n-eicosanoylamino)phenyl]urea (Compound No. 1 wherein n=19).

The test results are shown in Table 4.

Example 29

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by N-(1-naphthylsulfonyl)-N'-[4-(n-octadecanoyl-amino)phenyl]urea (Compound No. 16 wherein n=17).

The test results are shown in Table 4.

Example 30

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by N-(p-methoxybenzenesulfonyl)-N'[4-(n-octadecyloxy-carbonylamino)phenyl]urea (Compound No. 10 wherein n=18).

The test results are shown in Table 4.

Example 31

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by N-(2-naphthylsulfonyl)-N'-[4-(n-pentadecylthio-carbonylamino)phenyl]urea (Compound No. 25 wherein n=15).

The test results are shown in Table 4.

Example 32

A thermosensitive reversible recording material was produced and tested by the same procedures as in Example 27 except that in the preparation of the dispersion A, the 3-dibutylamino-6-methyl-7-anilinofluoran was replaced by 3-dibutylamino-7-(o-chloroanilino)fluoran.

The test results are shown in Table 4.

Comparative Example 9

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by N-(p-methoxybenzenesulfonyl)-N'[4-(n-pentanoyl-amino)phenyl]urea.

The test results are shown in Table 4.

Comparative Example 10

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by N-(1-naphthylsulfonyl)-N'-[4-(n-decanoyl-amino)phenyl]urea.

The test results are shown in Table 4.

Comparative Example 11

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by N-(4-hydroxyphenyl)-N'-n-octadecyl urea.

The test results are shown in Table 4.

Comparative Example 12

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by gallic acid.

The test results are shown in Table 4.

Comparative Example 13

A thermosensitive reversible recording material was produced and tested by the same procedures as in Example 27, except that in the preparation of the dispersion B, the N-(p-methoxybenzenesulfonyl)-N'-[4-(n-octadecanoylamino)phenyl]urea (Compound No. 1 wherein n=17) was replaced by ascorbic acid.

The test results are shown in Table 4.

TABLE 4

| Example No. | Color density of color-developed images (First time) | Color density of color-erased images (First time) | Color retention (%) | Color density of color-developed images (30-th time) | Color density of color-erased images (30-th time) | Repeat durability |
|---|---|---|---|---|---|---|
| | Item | | | | | |
| | | | Example | | | |
| 27 | 1.39 | 0.13 | 93 | 1.38 | 0.14 | >30 |
| 28 | 1.37 | 0.12 | 92 | 1.36 | 0.13 | >30 |
| 29 | 1.38 | 0.12 | 90 | 1.36 | 0.13 | >30 |
| 30 | 1.40 | 0.13 | 93 | 1.37 | 0.15 | >30 |
| 31 | 1.39 | 0.12 | 90 | 1.37 | 0.14 | >30 |
| 32 | 1.32 | 0.10 | 84 | 1.31 | 0.11 | >30 |
| | | | Comparataive Example | | | |
| 9 | 1.42 | 1.31(*) | 93 | — | — | — |
| 10 | 1.38 | 0.76 | 90 | 1.37 | 0.87 | >30 |
| 11 | 1.42 | 0.21 | 51 | 1.41 | 0.35 | >30 |
| 12 | 1.05 | 0.31 | 42 | 0.99 | 0.40 | >30 |
| 13 | 1.02 | 0.85 | 49 | 0.98 | 0.89 | >30 |

Note
*Developed color was maintained without being erased

As is clear from the comparison of Examples 27 to 32 with Comparative Examples 11 to 13, the colored images formed on the thermosensitive reversible recording materials of the present invention had a higher contrast than that of the colored images formed by using, as a color developing agent, a conventional phenol compound having a long chain alkyl group, gallic acid or ascorbic acid, and exhibited an excellent color retention.

Also, it is clear from the comparison of Examples 27 to 32 with Comparative Examples 9 and 10 that only when the sulfonyl urea compound used as a color-developing agent for the thermosensitive reversible recording material of the present invention had a long chain alkyl group having 11 carbon atoms or more in total, the sulfonylurea compound can exhibit a color-developing and erasing activity.

Industrial Applicability

The thermosensitive reversible recording material of the present invention can form thereon colored images on a white ground, and the colored images have a high contrast and an excellent color retention. Further, in the thermosensitive reversible recording material of the present invention, an overcoat layer formed on the thermosensitive recording layer and optionally, an intermediate barrier layer formed between the thermosensitive recording layer and the overcoat layer can impart a high practical durability for the repeated color-developing and erasing procedures applied to the thermosensitive recording layer. Accordingly, the thermosensitive reversible recording material of the present invention is very valuable in practice.

We claim:

1. A thermosensitive reversible recording material comprising:

a substrate sheet, and a thermosensitive recording layer formed on the substrate sheet and comprising a colorless or light colored dye precursor and a color-developing agent capable of reversibly color-developing and erasing the dye precursor, characterized in that the color-developing agent comprises at least one aromatic compound of the general formula (1):

(1)

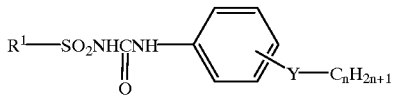

wherein $R^1$ represents a member selected from the class consisting of a naphthyl group, and a phenyl group substituted with at least one lower alkoxy group, and Y represents a member selected from the class consisting of divalent groups of the formulae:

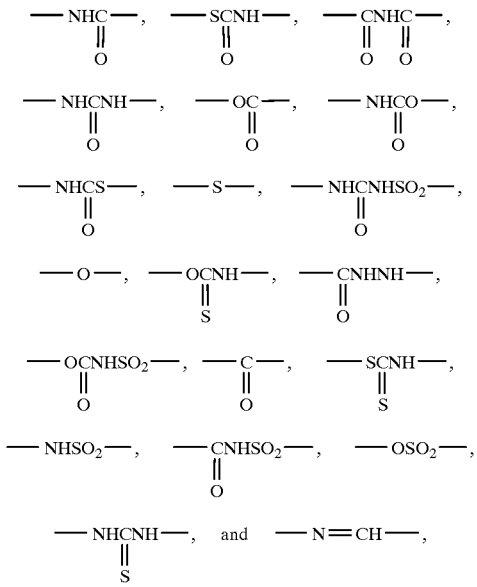

and n represents an integer of 11 to 30.

2. The thermosensitive reversible recording material as claimed in claim 1, wherein the thermosensitive recording layer is coated with an overcoat layer comprising, as a principal component, a polymeric material.

3. The thermosensitive reversible recording material as claimed in claim 2, wherein the polymeric material for the overcoat layer is a curing product of an electron-beam or ultraviolet-ray curable unsaturated organic compound with electron-beam or ultraviolet-ray irradiation.

4. The thermosensitive reversible colored image-recording material as claimed in claim 3, wherein the electron-beam or ultraviolet-ray curable unsaturated organic compound is selected from the class consisting of:

(1) acrylate and methacrylate compounds of aliphalic alcohols, cycloaliphatic alcohols, aromatic moiety-containing aliphalic alcohols, and polyalkylene glycols;

(2) acrylate and methacrylate compounds of addition reaction products of aliphalic, cycloaliphatic and aromatic moiety-containing aliphalic alcohols with alkyleneoxides;

(3) polyacryloyl and polymethacryloyl alkylphosphate esters;

(4) reaction products of polybasic acids with polyols and at least one member selected from the group consisting of acrylic acid and methacrylic acid;

(5) reaction products of isocyanate with polyols and at least one member selected from the group consisting of acrylic acid and methacrylic acid;

(6) reaction products of epoxy compounds with at least one member selected from the group consisting of acrylic acid and methacrylic acid; and (7) reaction products of epoxy compounds with polyols and at least one member selected from the group consisting of acrylic acid and methacrylic acid.

6. The thermosensitive reversible recording material as claimed in claim 2 or 3, wherein the overcoat layer further comprises at least one member selected from pigments and waxes.

7. The thermosensitive reversible recording material as claimed in claim 2 or 3, wherein the overcoat layer has a weight of 1 to 30 g/m$^2$.

8. The thermosensitive reversible recording material as claimed in claim 1, wherein $R^1$ in the formula (I) represents a member selected from the class consisting of the groups of the formulae:

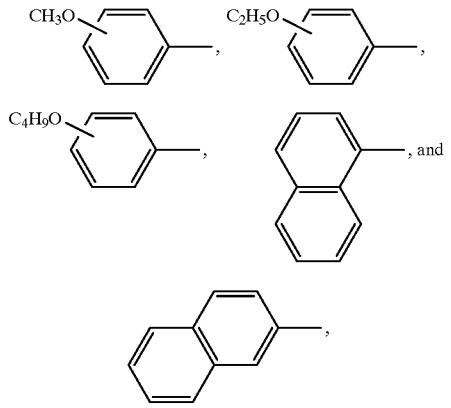

9. The thermosensitive reversible recording material as claimed in claim 1, wherein the aromatic compound of the formula (I) is selected from the class consisting of the compounds of the formulae (2) and (3):

(2)

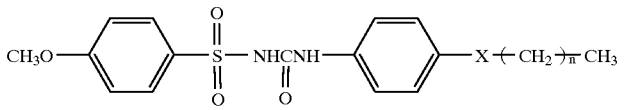

(3)

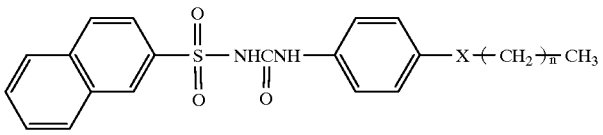

5. The thermosensitive reversible colored image-recording material as claimed in claim 2, wherein an intermediate barrier layer comprising, as a principal component, a film-forming polymer is formed between the thermosensitive reversible recording layer and the overcoat layer.

in which formulae (2) and (3), X represents a group of the formula: or and n represents an integer of 15 to 20.

* * * * *